US008435017B2

(12) United States Patent
Hamada et al.

(10) Patent No.: US 8,435,017 B2
(45) Date of Patent: May 7, 2013

(54) HERMETIC COMPRESSOR AND REFRIGERATION SYSTEM

(75) Inventors: Naohiro Hamada, Kyoto (JP); Kenji Kinjo, Shiga (JP)

(73) Assignee: Panasonic Corporation, Osaka (JP)

( * ) Notice: Subject to any disclaimer, the term of this patent is extended or adjusted under 35 U.S.C. 154(b) by 337 days.

(21) Appl. No.: 12/797,386

(22) Filed: Jun. 9, 2010

(65) Prior Publication Data

US 2010/0316515 A1 Dec. 16, 2010

(30) Foreign Application Priority Data

Jun. 12, 2009 (JP) ..... 2009-140778
Nov. 24, 2009 (JP) ..... 2009-265976
Mar. 12, 2010 (JP) ..... 2010-055750

(51) Int. Cl.
*F04B 17/00* (2006.01)
*F04B 35/04* (2006.01)

(52) U.S. Cl.
USPC ..... 417/415; 417/497; 417/902; 417/569

(58) Field of Classification Search ..... 417/415, 417/497, 902, 569
See application file for complete search history.

(56) References Cited

U.S. PATENT DOCUMENTS 1,233,693 A * 7/1917 Niebling ..... 137/516.17
2,161,133 A * 6/1939 Burke ..... 123/290
4,898,126 A * 2/1990 Merritt ..... 123/52.4
5,149,254 A * 9/1992 Riffe ..... 417/569
5,180,292 A * 1/1993 Abousabha et al. ..... 417/273
5,816,783 A * 10/1998 Oshima et al. ..... 417/415
6,162,030 A * 12/2000 Pierrat ..... 417/497
6,540,492 B2 * 4/2003 Kaido et al. ..... 417/562
6,623,258 B1 * 9/2003 Iversen et al. ..... 417/559
7,083,400 B2 * 8/2006 Possamai et al. ..... 417/559
7,380,493 B2 * 6/2008 Park et al. ..... 92/239
2005/0008517 A1 1/2005 Iversen et al.

FOREIGN PATENT DOCUMENTS

CN 1098477 2/1995
CN 1769672 5/2006
JP 56156479 A * 12/1981
JP 3205122 6/2001
JP 2002-130131 5/2002

OTHER PUBLICATIONS

Tsuneyo Ando, "Basic Engineering, Hydromechanics Version 3", pp. 184-185, Baifukan (1990).

* cited by examiner

*Primary Examiner* — Charles Freay
*Assistant Examiner* — Christopher Bobish
(74) *Attorney, Agent, or Firm* — Hamre, Schumann, Mueller & Larson, P.C.

(57) ABSTRACT

A valve plate includes a suction port to which gas to be compressed in a compression chamber flows in and a discharge port from which gas compressed in the compression chamber is discharged, a projection that appears from the discharge port with the reciprocating movement of the piston is arranged at a position facing the discharge port at a distal end face of the piston, and the projection includes a flat surface extending parallel to a reciprocating direction of the piston, so that a highly efficient hermetic type compressor that reduces the dead volume of the discharge port and reduces the loss in the compression chamber and the discharge port is provided.

11 Claims, 18 Drawing Sheets

--- Prior Art ---

--- Prior Art ---

--- Prior Art ---

HERMETIC COMPRESSOR AND REFRIGERATION SYSTEM

BACKGROUND OF THE INVENTION

1. Field of the Invention

The present invention relates to a hermetic type compressor used in a freezer cycle of an electric refrigerator, an air conditioner, a freezer-refrigeration device, and the like.

2. Description of the Related Art

Energy saving is advancing in home refrigerators in recent years, and higher efficiency is also advancing in a hermetic type compressor mounted in the home refrigerator.

A technique of reducing a dead volume of a discharge port with a projection of a piston to enhance efficiency, and reducing the loss and suppressing the decline of refrigerating capacity caused by re-expansion of compressed gas, is conventionally disclosed for the hermetic type compressor of the above type mounted in the home refrigerator. See for example, Unexamined Japanese Patent Publication No. 3205122 (patent document 1).

The conventional hermetic type compressor will be described below with reference to the drawings. FIG. 26 is a longitudinal cross-sectional view of the conventional hermetic type compressor described in patent document 1. FIG. 27 is a cross-sectional view of the main parts of the conventional hermetic type compressor. FIG. 28 is a perspective view of a piston of the conventional hermetic type compressor.

As shown in FIG. 26 to FIG. 28, conventional hermetic type compressor 20 accommodates compression element 2 and electrical element 3 in hermetic vessel 1, where an internal space is filled with refrigerant gas 4.

Compression element 2 is mainly configured by substantially cylindrical cylinder 5, and piston 6 inserted into cylinder 5 so as to freely reciprocate therein. Piston 6 is coupled with eccentric shaft 9 of crankshaft 8 by connecting means 7.

Valve plate 10 including suction port 11 and discharge port 12 is arranged at an end of cylinder 5. A suction valve (not shown) and a discharge valve (not shown) for opening/closing suction port 11 and discharge port 12, respectively, are also arranged at the end of cylinder 5.

Cylinder 5, valve plate 10, and piston 6 form compression chamber 19. Piston 6 reciprocates in cylinder 5 by the rotation of crankshaft 8 for transmitting the rotation force of electrical element 3. A compression mechanism for taking in, compressing, and discharging the refrigerant gas is thus formed in compression chamber 19.

As shown in detail in FIG. 27 and FIG. 28, conventional hermetic type compressor 20 has projection 14 corresponding to discharge port 12 arranged at an end face (distal end face) on valve plate 10 side of piston 6 to reduce the dead volume of discharge port 12. Projection 14 of piston 6 has a circular column (cylindrical) shape or a cone shape. Projection 14 of piston 6 is formed at a position entering discharge port 12 of valve plate 10.

In the fluid technique, documents disclosing a technique of forming a bell-mouth portion having an arcuate cross section at an inlet peripheral edge of the discharge port for discharging fluid and reducing the loss at the inlet peripheral edge involved in the flow of fluid are known. See for example, Basic engineering, Hydromechanics, Version 3 (Baifukan, 1990, P. 184 to 185 (non-patent document 1).

However, the conventional technique has a configuration capable of reducing the dead volume as projection 14 arranged on valve plate 10 side of piston 6 enters discharge port 12, but causing the flowing area of the refrigerant gas to gradually decrease. Other losses in compression chamber 19 and discharge port 12 increase with the complicating behavior of the refrigerant in compression chamber 19, and thus the refrigerant gas 4 cannot be completely flowed out from compression chamber 19. In other words, the refrigerant gas accumulating (remaining) in compression chamber 19 re-expands with the suction operation of piston 6, and as a result, effects from reduction of the dead volume in hermetic type compressor 20 cannot be fully exhibited such as the suction loss may occurs.

Consideration is made in applying the configuration disclosed in non-patent document 1 to discharge port 12 of conventional hermetic type compressor 20, but sufficient effects cannot be expected due to the loss (complicating behavior of refrigerant) at the periphery of discharge port 12 by projection 14.

SUMMARY OF THE INVENTION

It is an object of the present invention to provide a highly efficient hermetic type compressor and a freezer unit capable of reducing the dead volume and reducing the loss in the compression chamber and at the discharge port.

A hermetic type compressor of the present invention includes an electrical element and a compression element driven by the electrical element in an hermetic vessel, the compression element including a cylinder block with a compression chamber space, a piston that reciprocates in the compression chamber space, and a valve plate being arranged at an end of the compression chamber space and forming a compression chamber with the piston, the valve plate including a suction port to which gas to be compressed in the compression chamber flows in and a discharge port from which gas compressed in the compression chamber is discharged, a projection that appears from the discharge port with the reciprocating movement of the piston being arranged at a distal end face of the piston and at a position facing the discharge port, and the projection including a flat surface extending parallel to a reciprocating direction of the piston.

The dead volume thus can be reduced and the efficiency of the compressor can be enhanced. In addition, the flow of the gas flowing from the suction port to the discharge port is blocked from going around to the peripheral wall extending in the axial direction of the projection by the flat surface, so that the gas blocked by the flat surface can be guided in the direction of the discharge port. Therefore, the accumulation (amount) of the gas in the compression chamber at the termination of the compression stroke can be reduced, and the suction loss involved in the re-expansion of the accumulated gas can be reduced.

A freezer unit of the present invention includes a refrigerant circuit in which a compressor, a condenser, a expansion device, and a evaporator are annularly coupled by a piping, the compressor having the configuration of the hermetic type compressor described above.

With such configuration, a freezer unit in which the power consumption (amount) is suppressed can be obtained, and the energy of devices such as a dehumidification device, a showcase, and a vending machine including a home refrigerator, can be saved.

DETAILED DESCRIPTION OF THE PREFERRED EMBODIMENT

The embodiments of the present invention will be hereinafter described with reference to the drawings. It should be recognized that the present invention is not limited by such embodiments.

First Exemplary Embodiment

Figure 1:
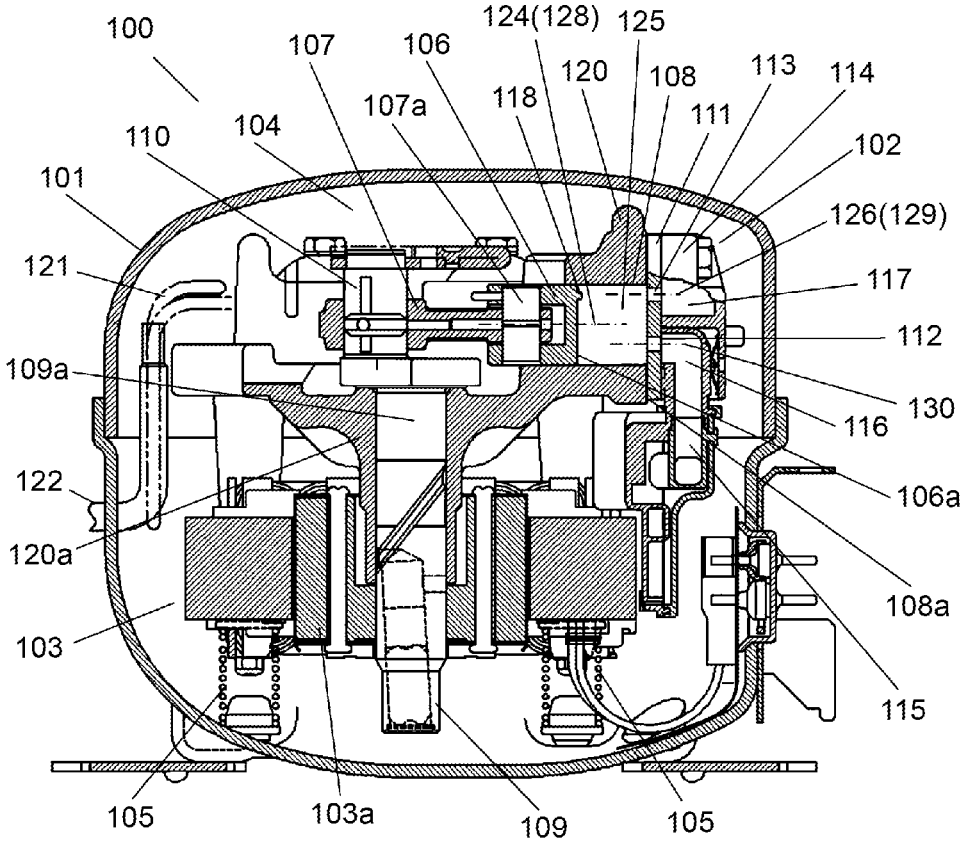
FIG. 1 is a longitudinal cross-sectional view of a hermetic type compressor according to a first embodiment of the present invention.
Figure 2:
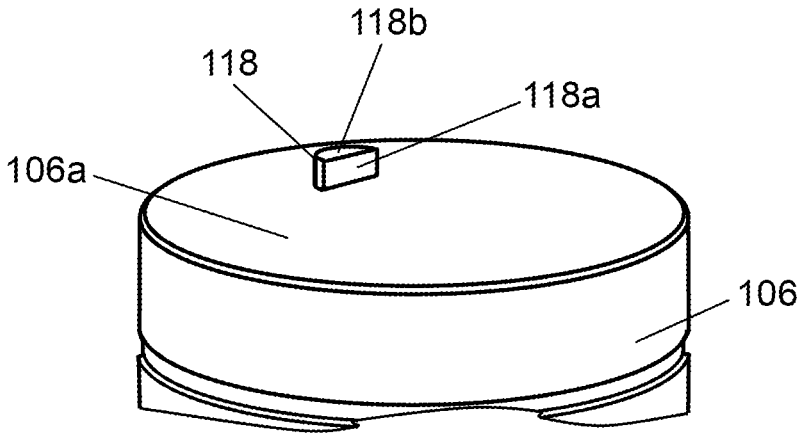
FIG. 2 is a perspective view of the main parts of a piston of the hermetic type compressor according to the first embodiment.
Figure 3:
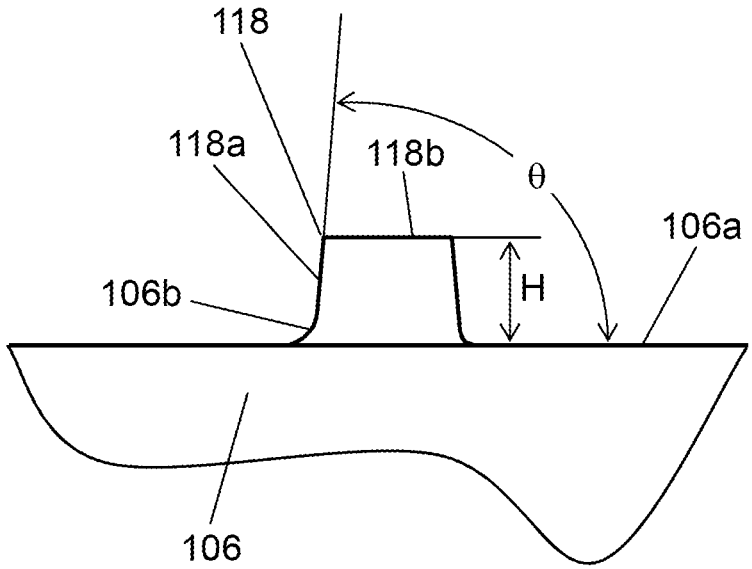
FIG. 3 is a side view of the main parts of the piston of the hermetic type compressor according to the first embodiment.
Figure 4:
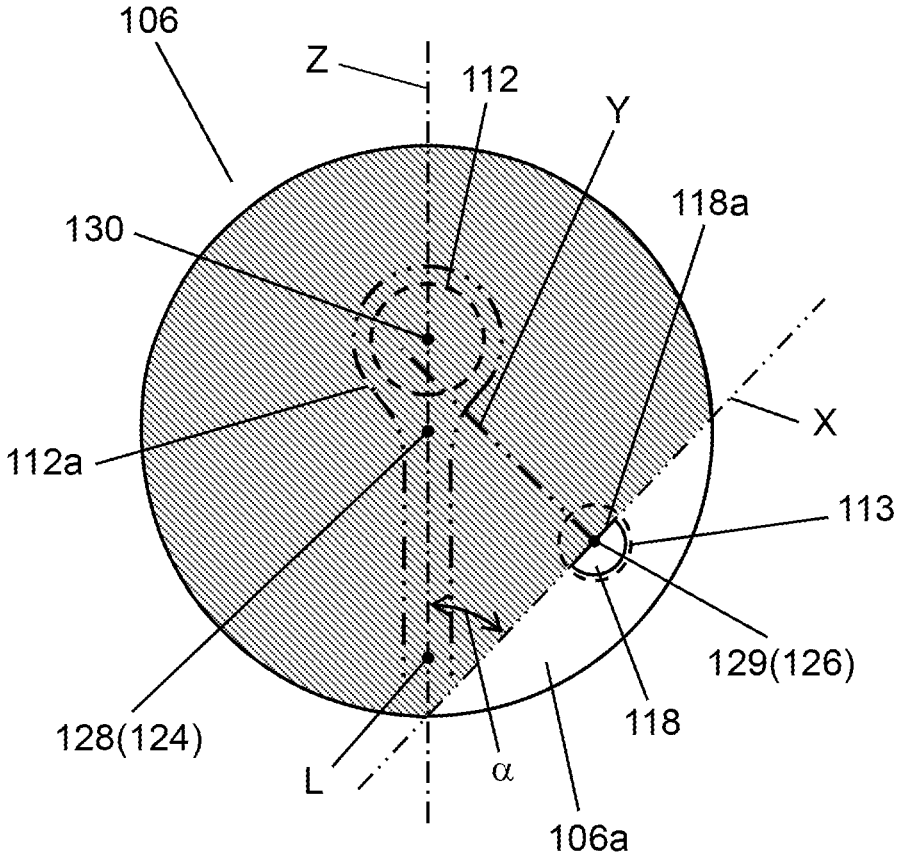
FIG. 4 is an explanatory view showing an arrangement relationship of a suction port and a discharge port of a projection when seen from the compression surface of the piston of the hermetic type compressor according to the first embodiment.
Figure 5:
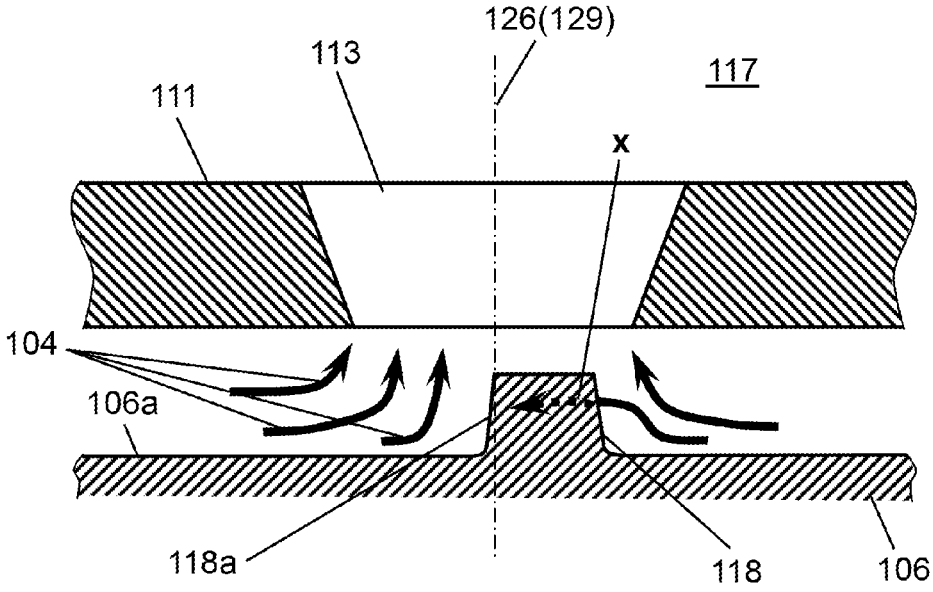
FIG. 5 is a cross-sectional view of the main parts describing the flow of refrigerant gas before the termination of the compression stroke of the hermetic type compressor according to the first embodiment.
Figure 6:
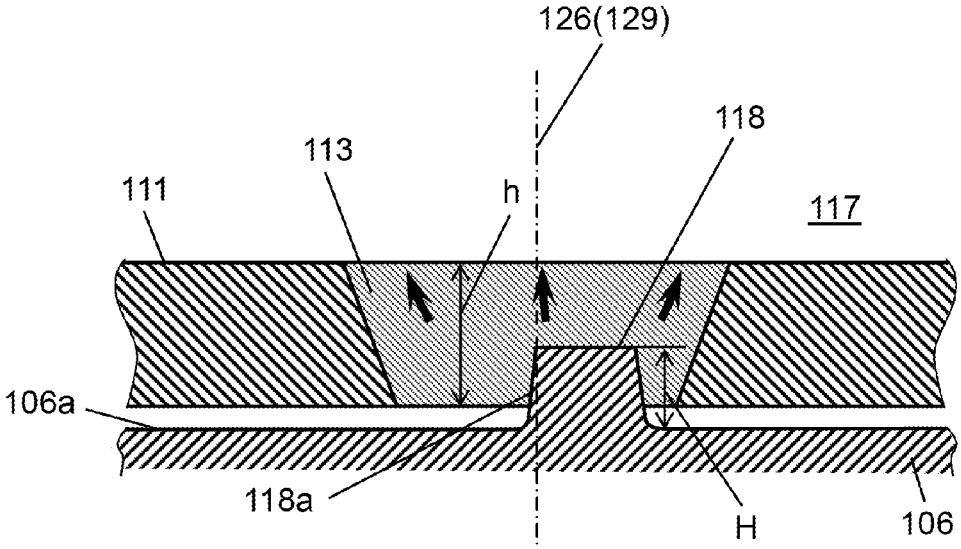
FIG. 6 is a cross-sectional view of the main parts describing the flow of refrigerant gas at the termination of the compression stroke of the hermetic type compressor according to the first embodiment.
Figure 7:
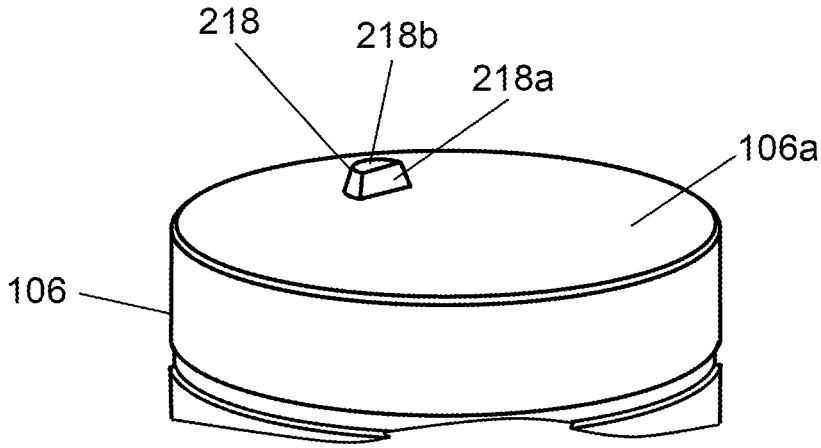
FIG. 7 is a perspective view of the main parts of the piston including a projection having a different configuration according to the first embodiment.
Figure 8:
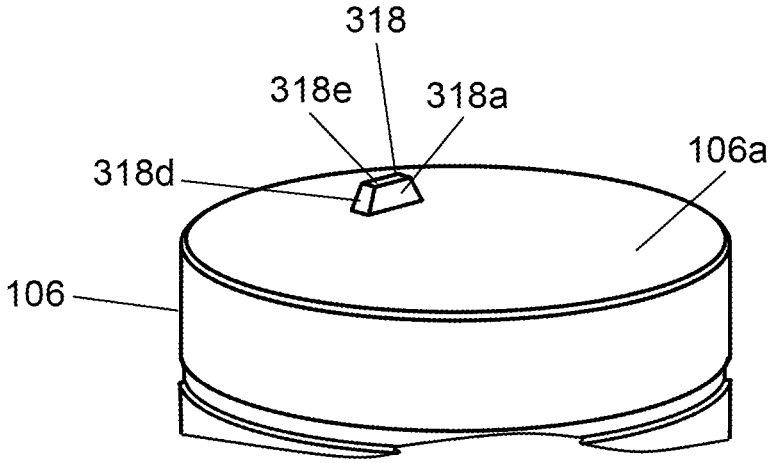
FIG. 8 is a perspective view of the main parts of the piston including a projection having a further different configuration according to the first embodiment.

FIG. 1 is a longitudinal cross-sectional view of a hermetic type compressor according to a first embodiment of the present invention. FIG. 2 is a perspective view of the main parts of a piston of the hermetic type compressor according to the first embodiment. FIG. 3 is a side view of the main parts of the piston of the hermetic type compressor according to the first embodiment. FIG. 4 is an explanatory view showing an arrangement relationship of a suction port and a discharge port of a projection when seen from the compression surface of the piston of the hermetic type compressor according to the first embodiment. FIG. 5 is a cross-sectional view of the main parts describing the flow of refrigerant gas before the termination of the compression stroke of the hermetic type compressor according to the first embodiment. FIG. 6 is a cross-sectional view of the main parts describing the flow of refrigerant gas at the termination of the compression stroke of the hermetic type compressor according to the first embodiment. FIG. 7 is a perspective view of the main parts of the piston including a projection having a different configuration according to the first embodiment. FIG. 8 is a perspective view of the main parts of the piston including a projection having a further different configuration according to the first embodiment.

As shown in FIG. 1, hermetic type compressor (hereinafter referred to as compressor) 100 has hermetic vessel 101 filled with refrigerant gas (gas) 104, and electrical element 103 and compression element 102, which is driven by electrical element 103, elastically supported and accommodated in hermetic vessel 101 by suspension spring 105.

Compression element 102 is mainly configured by cylinder block 120 including crankshaft 109 for converting the rotational movement of electrical element 103 to reciprocating movement, and cylinder 108 having a substantially cylindrical compression chamber space. Crankshaft 109 includes main shaft portion 109*a* on which rotor 103*a* of electrical element 103 is fixed, and eccentric shaft portion 110 which axial center is eccentric with respect to main shaft portion

109*a*. Main shaft portion 109*a* is supported by main bearing portion 120*a* of cylinder block 120.

Piston 106 is inserted in cylinder 108 so as to freely reciprocate therein. Piston 106 is coupled with eccentric shaft portion 110 of crankshaft 109 by way of connecting means 107. In other words, connecting means 107 has one end coupled in a freely rotatable manner with eccentric shaft portion 110 of crankshaft 109, and the other end coupled in a freely rotatable manner with piston pin 107*a* attached to piston 106. Thus, connecting means 107 converts the pivotal turn of eccentric shaft portion 110 involved in the rotation of crankshaft 109 to reciprocating movement, and transmits the same to piston 106.

End 108*a* of cylinder 108 includes valve plate 111. Valve plate 111, piston 106, and cylinder 108 form compression chamber 125.

Valve plate 111 includes suction port 112 and discharge port 113, which are respectively formed to a circle, and also include suction valve 112*a* (FIG. 4) for opening/closing suction port 112 and a discharge valve (not shown) for opening/closing discharge port 113 in well-known configurations. A supporting point (starting point) L of the opening/closing of suction valve 112*a* is set on a line Z, to be described later, and is closer to discharge port 113.

Valve plate 111 is covered by cylinder head 114, where suction chamber 116 for communicating suction muffler 115 and suction port 112, and discharge chamber 117 communicating to discharge port 113 are arranged inside cylinder head 114.

Discharge chamber 117 is connected with discharge tube 121, and outlet tube 122 extending to the exterior of hermetic vessel 101 is connected to discharge tube 121.

Projection 118 that appears from discharge port 113 with the reciprocating movement of piston 106 is integrally arranged at a position corresponding to discharge port 113 at an end face on valve plate 111 side of piston 106, that is, distal end face 106*a*.

Furthermore, discharge port 113 formed in valve plate 111 has a port diameter formed such that the cross-sectional area increases from compression chamber 125 side towards the opposite side (cylinder head 114 side) of compression chamber 125, as shown in FIGS. 5 and 6. The port is also formed to a size projection 118 of piston 106 can easily enter. Discharge port 113 is arranged on axial center 126 at a position eccentric to outer peripheral side than axial center 124 of compression chamber 125.

Therefore, since discharge port 113 appears at the time of reciprocating movement of piston 106 even with respect to the position of axial center 129 of projection 118, it (substantially) coincides axial center 126 of discharge port 113, and is arranged at a position eccentric to the outer peripheral side than axial center 124 of compression chamber 125 and axial center 128 of piston 106 that (substantially) coincides axial center 124.

As shown in FIGS. 2 and 4, projection 118 is founded on a shape in which a circular column is cut in half in the axial direction, and flat surface 118*a* or the cut surface faces axial center 128 side of piston 106.

Axial center 129 of projection 118 is set to the axial center for the case of circular column for the sake of convenience of the explanation, but can be set to the axial center (not shown) of semi-circular column (actual shape). Surface 118*b* at the top portion of projection 118 is a plane.

The positional relationship of projection 118 (discharge port 113) and suction port 112 formed in valve plate 111 is such that suction port 112 is positioned at a projection surface (hatching region) from an extended line X of flat surface 118*a* to a region beyond axial center 128 of piston 106, as shown in FIG. 4.

Furthermore, an angle θ (FIG. 3) formed by flat surface 118*a* and distal end face 106*a* of piston 106 is set to about 90°. The angle θ slightly includes separation gradient (angle) of the die as piston 106 and projection 118 are molded in the die, which separation gradient can be arbitrarily set.

The angle θ is defined in a range of about $70° \leqq \theta \leqq 90°$ in the first embodiment due to the reason to be described later.

As shown in FIG. 4, the direction of flat surface 118*a* is set such that the extended line X of flat surface 118*a* extending in a direction intersecting axial center 128 of piston 106 forms an angle (hereinafter referred to as arrangement angle) α (about 45° in the first embodiment) with respect to the line Z passing axial center (center) 130 of suction port 112 and axial center (center) 128 of piston 106 when seen from distal end face 106*a* side of piston 106.

The arrangement angle α is right angle to flat surface 118*a*, and can be defined as an arrangement relationship in which a line Y passing the center of flat surface 118*a* intersects the line Z passing axial center 130 of suction port 112 and axial center 128 of piston 106 in a range of a predetermined angle. In particular, in the first embodiment, the angle is set such that the line Y intersects at between axial center 130 of suction port 112 and axial center 128 of piston 106.

Therefore, the arrangement angle α (about 45°) at which the extended line X of flat surface 118*a* intersects sometimes differs with respect to the line Z passing axial center 130 of suction port 112 and axial center 128 of piston 106 according to the position of suction port 112.

Furthermore, curved surface 106*b* (FIG. 3) of a predetermined diameter is formed at a portion (projecting portion of projection 118) where flat surface 118*a* of projection 118 intersects at distal end face 106*a* of piston 106. In other words, flat surface 118*a* of projection 118 has a shape that partially includes curved surface 106*b*. The area of curved surface 106*b* (area ratio occupying in flat surface 118*a*) is set according to design data such as interval with inner diameter of discharge port 113 or area of distal end face 106*a* (volume of cylinder 108) of piston 106.

A height H of projection 118 is set slightly lower than a height h (FIG. 6) of valve plate 111.

The operation and the effect of compressor 100 configured as above will be described below. Compressor 100 is configured such that a refrigerant circuit connected with a condenser, a depressurizer, and an evaporator (all of which are not shown) is connected between the suction tube (not shown) and outlet tube 122 as well known to configure a well-known freezer cycle. R600a is adopted for refrigerant gas 104 to be compressed.

When current flows to electrical element 103, rotor 103*a* rotates thereby rotating crankshaft 109, and rotational (pivotal) movement of eccentric shaft portion 110 of crankshaft 109 is transmitted to piston 106 through connecting means 107. Therefore, piston 106 reciprocates in cylinder 108.

In the suction stroke in which piston 106 moves from an upper dead center to a bottom dead center, the volume of compression chamber 125 increases with the movement of piston 106 to crankshaft 109 side, and hence the pressure inside compression chamber 125 lowers, suction valve 112*a* opens with the supporting point L as a base point by the pressure difference between suction chamber 116 formed in cylinder head 114 and the interior of compression chamber 125, and compression chamber 125 and suction chamber 116 communicate through suction port 112.

Therefore, refrigerant gas 104 is guided to hermetic vessel 101 from the refrigerant circuit, and taken into compression chamber 125 sequentially passing suction muffler 115, suction chamber 116, and suction port 112.

In the compression stroke in which piston 106 moves from the bottom dead center to the upper dead center, suction valve 112*a* closes suction port 112 with the movement of piston 106 towards valve plate 111 side, and the volume of the interior of compression chamber 125 reduces. Accompanied therewith, refrigerant gas 104 in compression chamber 125 is compressed, and the pressure in compression chamber 125 rises.

When the pressure in compression chamber 125 rises to the pressure in discharge chamber 117, the discharge valve opens by the pressure difference between discharge chamber 117 and the interior of compression chamber 125, and compressed refrigerant gas 104 is discharged from discharge port 113 to discharge chamber 117 in cylinder head 114 until piston 106 reaches the upper dead center.

Refrigerant gas 104 discharged to discharge chamber 117 passes discharge tube 121 and is sent to the refrigerant circuit at the exterior of hermetic vessel 101 from outlet tube 122, thereby forming the freezer cycle.

Each stroke of suction, compression, and discharge is repeatedly carried out for every rotation of crankshaft 109, and refrigerant gas 104 circulates through the freezer cycle.

The flow of refrigerant gas 104 discharged from discharge port 113 in the above-described discharge stroke will be described in detail with reference to FIGS. 5 and 6. For the sake of convenience, the discharge stroke will be described as contained in the compression stroke based on the movement direction of piston 106.

As shown in FIG. 5, when the volume of compression chamber 125 reduces in the last half of the compression stroke, distal end face 106*a* of piston 106 approaches valve plate 111, and at the same time, projection 118 approaches opposing discharge port 113. The discharge valve opens with rise of pressure in compression chamber 125.

At the same time as the discharge valve opens, refrigerant gas 104 compressed in compression chamber 125 is discharged all at once to discharge chamber 117 in cylinder head 114 through discharge port 113, as shown with an arrow in the figure.

As the compression stroke advances, projection 118 of piston 106 enters opposing discharge port 113, as shown in FIG. 6, and the compression stroke is terminated leaving one part of compressed refrigerant gas 104 in a dead volume (microscopic hatching portion) formed by projection 118 and discharge port 113 and in a microscopic interval space between valve plate 111 and distal end face 106*a* of piston 106.

The flow of refrigerant gas 104 in compression chamber 125 in the compression stroke is the three-dimensional flow in which the speed as well as the flow direction greatly change, and shows a complicating behavior.

In the first embodiment, flat surface 118*a* is formed at the side wall of projection 118 arranged at distal end face 106*a* of piston 106 so that refrigerant gas 104 does not easily go around the periphery of projection 118.

Therefore, as shown in FIG. 5, the flow path of refrigerant gas 104 formed with discharge port 113 and projection 118 becomes narrow and the flow speed of refrigerant gas 104 becomes fast particularly near the termination of the compression stroke. On the opposite side of flat surface 118*a* of projection 118, one part is assumed to go around the periphery (side surface) of projection 118 as shown with arrow x. Thus, in the refrigerant gas of the flow opposing flat surface 118*a*, the flow that goes around the periphery (side surface) of projection 118 is suppressed by flat surface 118*a*, and the flow component guided to discharge port 113 is assumed to increase.

Furthermore, since curved surface 106*b* (FIG. 3) is formed at the portion where flat surface 118*a* projects out from distal end face 106*a*, the flow of refrigerant gas 104 that flows along flat surface 118*a* becomes smooth, and the effect of alleviating the complicating behavior of refrigerant gas 104 can be expected.

As the compression stroke further advances, the flow path of refrigerant gas 104 formed with discharge port 113 and projection 118 becomes very small, and the flow resistance of refrigerant gas 104 further increases, as shown in FIG. 6, at immediately before piston 106 reaches the upper dead center. Furthermore, as the flow of refrigerant gas 104 is guided to discharge port 113 by flat surface 118*a*, the amount of refrigerant gas 104 that accumulates in compression chamber 125 reduces, and the suction loss involved in re-expansion can be reduced.

As a result, the flow of refrigerant gas 104 near discharge port 113 involved in the complicating behavior of refrigerant gas 104 can be improved, the re-expansion of refrigerant gas 104 accumulated near the termination of the compression stroke of compressor 100 can be reduced, and the electrical input of compressor 100 can be reduced.

In the description made above, projection 118 has been described as founded on a shape in which the circular column is cut in half in the axial direction, but projection 218 may have a configuration where a shape in which a circular truncated cone is cut in half in the axial direction to form flat surface 218*a* is the base, as shown in FIG. 7. Alternatively, as shown in FIG. 8, projection 318 may have a configuration in which a truncated pyramid (square column) shape such as a rectangular solid having plural flat surfaces 318*a*, 318*d* and top surface 318*e* is the base. In either case, similar effects can be expected on similar conditions for the relationship of discharge port 113 and axial center 126, the relationship of suction port 112 and flat surface 218*a*, 318*a*, and the like.

Furthermore, surface 118*b*, 218*b*, 318*e* at the top portion in a relationship substantially parallel to distal end face 106*a* of piston 106 in projection 118, 218, 318 is not limited to a flat surface, and similar effects can be expected even if the relevant surface is a curved surface.

In other words, projection 118, 218, 318 preferably has a shape including flat surface 118*a*, 218*a*, 318*a* for suppressing refrigerant gas 104 from going around the periphery (side surface) of projection 118, 218, 318 near the termination of the compression stroke by piston 106 and cylinder 108. In other words, similar effects can be expected with the configuration of each projection 118, 218, 318 shown in FIG. 2, FIG. 7, FIG. 8 as the configuration of suppressing refrigerant gas 104 from going around to the periphery (side surface).

Therefore, according to the first embodiment, the volume of the dead volume formed with projection 118, 218, 318 in discharge port 113 is reduced by the formation of projection 118, 218, 318, and the efficiency of compressor 100 is enhanced. In addition, the accumulation (remaining) of refrigerant gas 104 near discharge port 113 involved in the complicating behavior can be suppressed and the flow of refrigerant gas 104 can be improved by forming flat surface 118*a*, 218*a*, 318*a* at projection 118, 218, 318.

As a result, the flow of refrigerant gas 104 to discharge port 113 is generated even near the termination of the compression stroke, the re-expansion of accumulated refrigerant gas 104 in compressor 100 is reduced, and the electrical input of compressor 100 can be reduced.

Second Exemplary Embodiment

Figure 9:
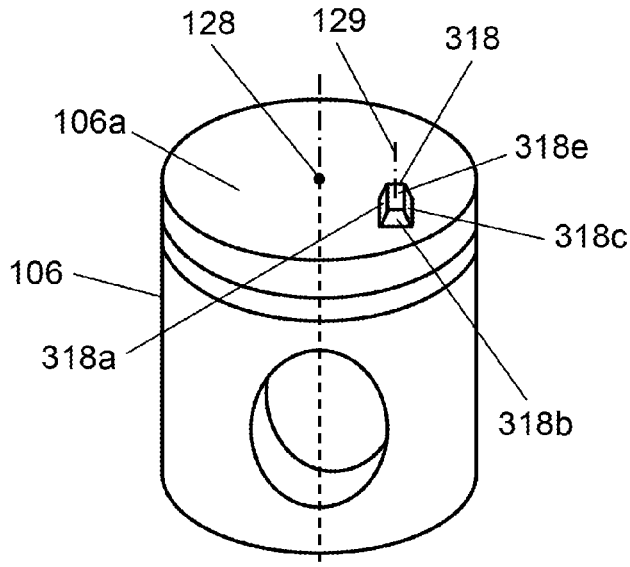
FIG. 9 is a perspective view of a piston of a hermetic type compressor according to a second embodiment of the present invention.
Figure 10:
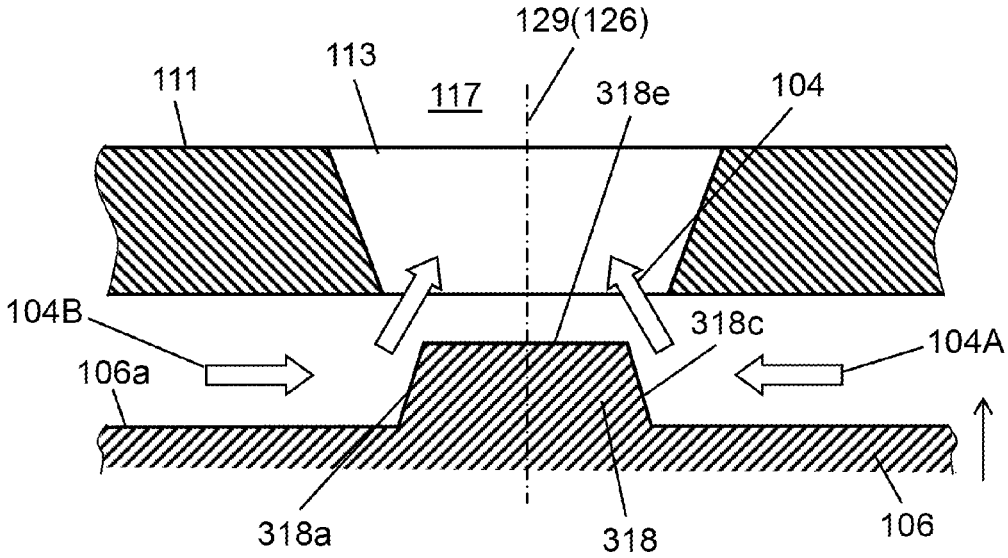
FIG. 10 is a cross-sectional view of the main parts of the hermetic type compressor according to the second embodiment.
Figure 11:
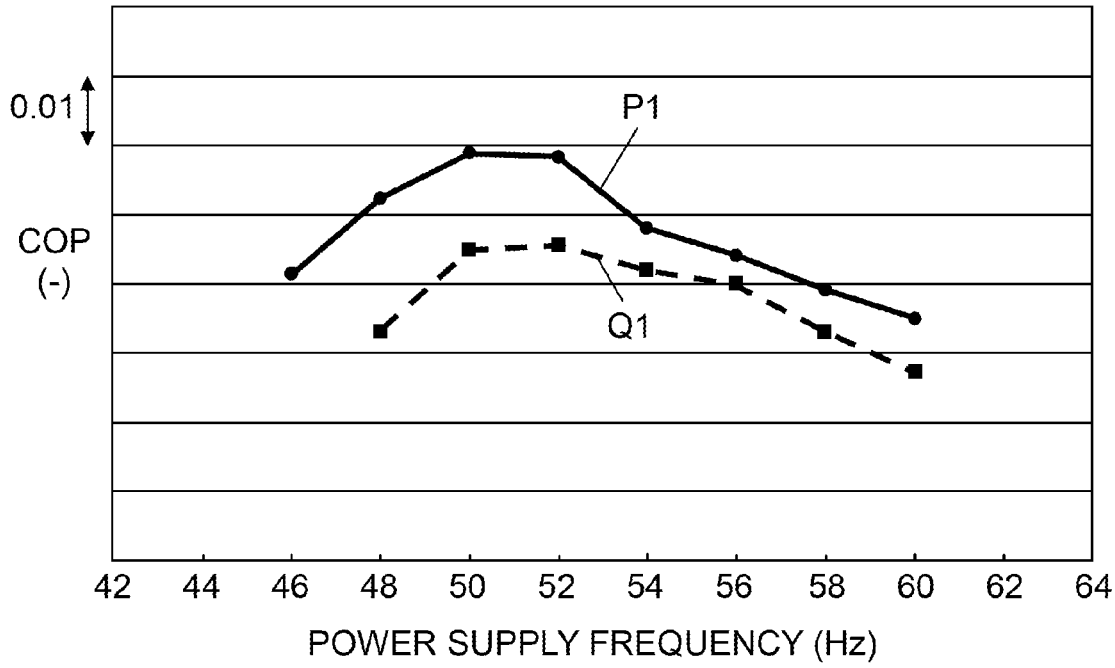
FIG. 11 is a characteristic comparison diagram of the hermetic type compressor according to the second embodiment.

FIG. 9 is a perspective view of a piston of a hermetic type compressor according to a second embodiment of the present invention. FIG. 10 is a cross-sectional view of the main parts of the hermetic type compressor according to the second embodiment. FIG. 11 is a characteristic comparison diagram of the hermetic type compressor according to the second embodiment.

FIG. 1 and the content of the first embodiment are cited for the entire configuration and the description of the hermetic type compressor, and the description thereof will be omitted. The same reference numerals are denoted for the configuring elements same as the first embodiment, and the contents different from the first embodiment will be mainly described herein.

As shown in FIGS. 9 and 10, projection 318 has a shape in which the solid rectangular body of FIG. 8 described in the first embodiment is the base, where four flat surface (hereinafter referred to as side wall) 318*a*, 318*b*, 318*c* (the reference numeral is denoted only on the flat surface seen) and top surface 318*e* are formed. Projection 318 has top surface 318*e* perpendicular to axial center 128 of piston 106 formed to a substantially rectangular shape.

Furthermore, four side walls 318*a*, 318*b*, 318*c* of projection 318 have the cross-sectional shape formed to a slightly tapered shape, as shown in FIG. 10, where each side wall 318*a*, 318*b*, 318*c* approaches and the cross-sectional area of the horizontal cross-section reduces towards the top portion (top surface 318*e*) at the position distant from distal end face 106*a* of piston 106. Projection 318 has axial center 129 thereof arranged at the position coinciding with axial center 126 of discharge port 113.

The operation and the effect of hermetic type compressor (hereinafter referred to as compressor) 100 including piston 106 configured as above will be described below. Compressor 100 is configured such that a freezer cycle (refrigerant circuit) connected with a condenser, a depressurizer, and an evaporator (all of which are not shown) is connected between the suction tube (not shown) and outlet tube 122 as well known to configure a well-known freezer cycle. R600a is adopted for refrigerant gas 104 to be compressed.

The operation and the effect of compressor 100 configured as above will be described below. When current flows to electrical element 103, rotor 103*a* rotates thereby rotating crankshaft 109, and the rotational movement of eccentric shaft portion 110 of crankshaft 109 is transmitted to piston 106 through connecting means 107, so that piston 106 reciprocates in cylinder 108.

In the suction stroke in which piston 106 moves from an upper dead center to a bottom dead center, the volume of compression chamber 125 increases, and hence the pressure inside compression chamber 125 lowers, the suction valve (not shown in the second embodiment) opens by the pressure difference between suction chamber 116 formed in cylinder head 114 and the interior of compression chamber 125, and compression chamber 125 and suction chamber 116 communicate through suction port 112.

In the suction stroke in which piston 106 moves from the upper dead center to the bottom dead center, the volume of compression chamber 125 increases, and hence the pressure inside compression chamber 125 lowers, the suction valve opens by the pressure difference between suction chamber 116 formed in cylinder head 114 and the interior of compression chamber 125, and compression chamber 125 and suction chamber 116 communicate through suction port 112.

Therefore, refrigerant gas 104 is guided to hermetic vessel 101 from the freezer cycle (not shown), and taken into compression chamber through suction muffler 115, suction chamber 116, and suction port 112.

In the compression stroke in which piston 106 moves from the bottom dead center to the upper dead center, the suction valve closes suction port 112 and refrigerant gas 104 in compression chamber 125 is compressed to raise the pressure with the reduction of the volume of the interior of compression chamber 125. When the pressure in compression chamber 125 rises to the pressure in discharge chamber 117, the discharge valve (not shown) opens by the pressure difference between discharge chamber 117 and the interior of compression chamber 125, and compressed refrigerant gas 104 is discharged to discharge chamber 117 in cylinder head 114 through discharge port 113 until piston 106 reaches the upper dead center.

Refrigerant gas 104 discharged to discharge chamber 117 passes discharge tube 121 and is sent to the freezer cycle at the exterior of hermetic vessel 101 from outlet tube 122. Each stroke of suction, compression, and discharge is repeatedly carried out for every rotation of crankshaft 109.

Piston 106 and discharge port 113 in the discharge stroke will be described in detail with reference to FIGS. 9 and 10. For the sake of convenience, the discharge stroke will be described as contained in the compression stroke based on the movement direction of piston 106.

As shown in FIG. 10, when the volume of compression chamber 125 reduces in the last half of the compression stroke, distal end face (end) 106*a* of piston 106 approaches valve plate 111, and at the same time, projection 318 approaches opposing discharge port 113, so that the discharge valve opens.

At the same time as when the discharge valve opens, refrigerant gas 104 compressed in compression chamber 125 is discharged all at once to discharge chamber 117 in cylinder head 114 through discharge port 113, as shown with an arrow in FIG. 10.

As the compression stroke advances, projection 318 of piston 106 enters opposing discharge port 113, and the compression stroke is terminated leaving one part of compressed refrigerant gas 104 in a dead volume formed by projection 318 and discharge port 113 and in a microscopic interval space of valve plate 111 and distal end face 106*a* of piston 106.

The flow of refrigerant gas 104 in compression chamber 125 in the compression stroke is the three-dimensional flow in which the speed as well as the flow direction greatly change, and shows a complicating behavior. As well known in the art, the volume of the dead volume formed by projection 318 and discharge port 113 greatly influences the efficiency of hermetic type compressor 100. However, the present invention experimentally found that the shape of projection 318 of piston 106 also influences to the same or greater extent as the volume of the dead volume.

The effects of the shape of projection 318 of piston 106 will be described below. FIG. 11 shows the result of measuring the efficiency with respect to compressor 100 including piston 106 of the above configuration in comparison with conventional hermetic type compressor 20. The horizontal axis is a power supply (operation) frequency, and the vertical axis is the coefficient of performance COP. In FIG. 11, a solid line P1 shows the characteristics of a hermetic type compressor of the present embodiment. A dotted line Q1 shows the characteristics of the conventional hermetic type compressor.

As shown in FIG. 11, the efficiency is experimentally recognized to be higher than conventional hermetic type compressor 20 including projection 14 of circular column (cylindrical) shape by having projection 318 of piston 106 as a tapered shape in which the horizontal cross-sectional shape is substantially rectangular and each side wall 318*a*, 318*b*, 318*c* approaches towards the top portion (top surface 318*e*). The experimental result proves that the shape of projection 318 of piston 106 influences the efficiency in addition to the volume of the dead volume and the shape of discharge port 113.

Although the effect of enhancing the efficiency differs depending on the operation frequency, the enhancement of the efficiency of compressor 100 is the experimentally recognized result under the condition generally operated in the home refrigerator in the entire frequency range of the power supply frequency (operation frequency) from about 45 Hz to 60 Hz, where the coefficient of performance COP enhances and the energy can be saved by inverter driving at the operation frequency including 50 Hz and 60 Hz.

The experimental results shown in FIG. 11 will be inferred below. If the so-called horizontal cross-sectional shape cut perpendicular to the extending (axial) direction of projection 318 is substantially rectangular instead of circular, that is, if projection 318 has a shape in which the rectangular solid is the base rather than the shape of the prior art in which the circular column (circular truncated cone) is the base, refrigerant flow 104A, 104B in the perpendicular direction with respect to the extending direction (side walls 318*a*, 318*b*, 318*c*) of projection 318 of refrigerant gas 104 in compression chamber 125 shows a behavior different from the shape in which the circular column is the base, as shown in FIG. 10, which is assumed as the main factor for the enhancement of the efficiency.

Specifically, in the case of projection 318 of the second embodiment, refrigerant flow 104A, 104B hits side walls 318*a*, 318*b*, 318*c* different from each other. However, refrigerant flow 104A, 104B is suppressed from going around each side wall 318*a*, 318*b*, 318*c* since each side 318*a*, 318*b*, 318*c* is a flat surface. As a result, the refrigerant flow is suppressed from going around the periphery of each side wall 318*a*, 318*b*, 318*c* and disturbing the flow of the counterpart compared to the shape in which the circular column is the base.

Therefore, the mutual interference of refrigerant flow 104A, 104B that hit each side wall 318*a*, 318*b*, 318*c* can be suppressed. As a result, it is assumed that the loss caused by the disturbance of the flow can be reduced, and the flow-in of refrigerant gas 104 to discharge port 113 becomes smoother.

In other words, in the case of projection 14 having a circular column (circular truncated cone) shape as in conventional hermetic type compressor 20, the refrigerant gas that hits projection 14 goes around in the circumferential direction, whereby the flow may be disturbed and the loss may increase.

Therefore, projection 318 shown in the second embodiment is formed to a tapered shape such that the cross-sectional area of the horizontal cross-section becomes smaller towards valve plate 111 side, that is, four side walls 318*a*, 318*b*, 318*c* approach, the refrigerant gas 104 can be assumed to be guided in the direction of discharge port 113 more smoothly while reducing the flow of refrigerant gas 104 that hit each side wall 318*a*, 318*b*, 318*c* from going around the periphery of side wall 318*a*, 318*b*, 318*c*.

In the shape of projection 318, the curved shape instead of the tapered shape in which four side walls 318*a*, 318*b*, 318*c* approach towards top surface 318*e* of the top portion of projection 318, also can be expected to have the enhancement effect of the efficiency compared to conventional projection 14 of circular column shape, although a slight difference is found in the enhancement effect, and the implementation similar to the tapered shape can be carried out.

A case in which the cross-sectional shape (horizontal cross-sectional shape) of projection 318 by the flat surface perpendicular to axial center 128 of piston 106 is a substantially rectangular shape has been described. However, although a slight difference is seen in the enhancement effect of the efficiency even if projection 318 is a polygonal shape such as a triangle or a pentagon shape, the enhancement effect of the efficiency can be expected compared to conventional projection 14 of circular column shape and the implementation can be similarly carried out.

Discharge port 113 formed in valve plate 111 is formed so that the cross-sectional area becomes greater towards the opposite side of compression chamber 125 from compression chamber 125 side. However, although a difference is seen in the enhancement effect of the efficiency even with discharge port 113 in which the cross-sectional area is a uniform cylindrical shape, the enhancement effect of the efficiency can be expected compared to conventional hermetic type compressor 20 and the implementation can be similarly carried out.

By mounting hermetic type compressor 100 according to the first and second embodiments in the freezer unit including freezer cycle, the efficiency can be enhanced as the freezer unit, and the energy can be saved.

Third Exemplary Embodiment

Figure 12:
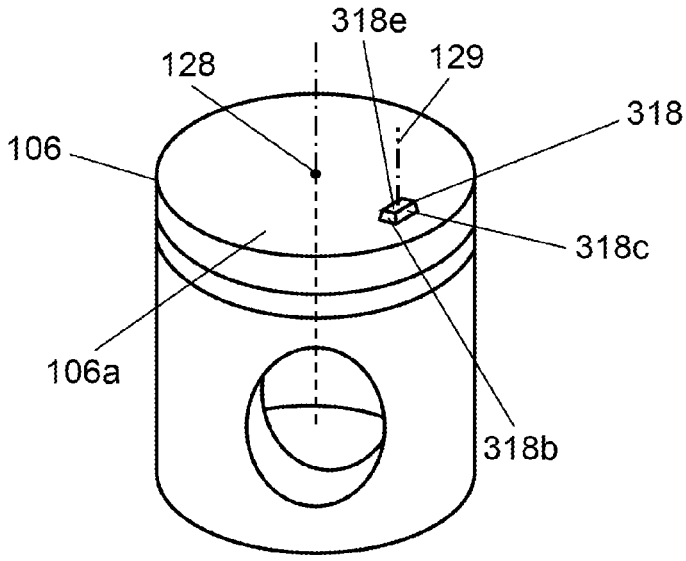
FIG. 12 is a perspective view of a piston configuring a hermetic type compressor according to a third embodiment of the present invention.
Figure 13:
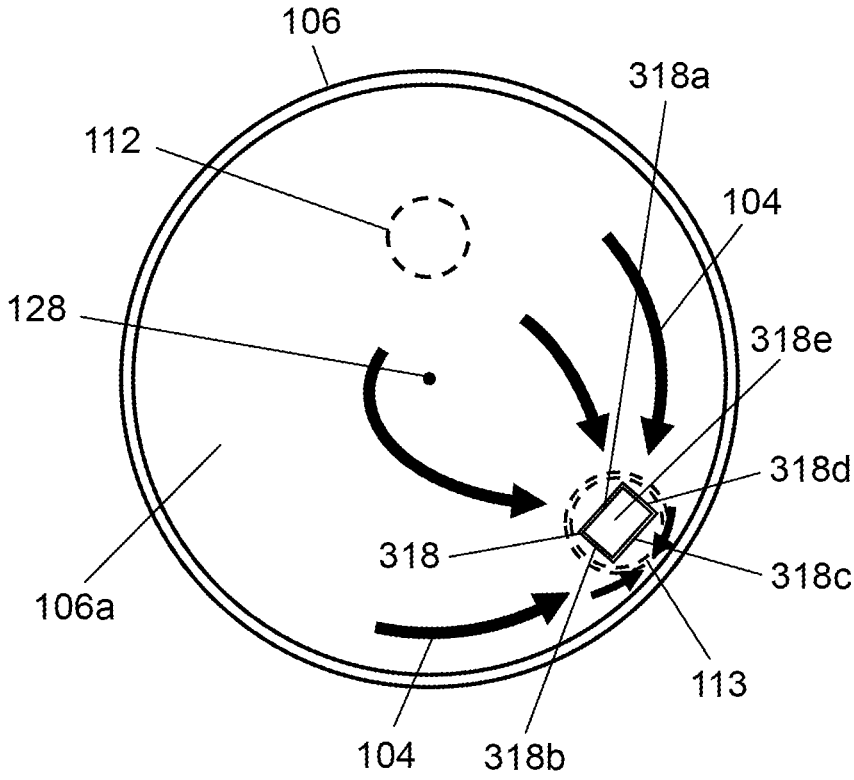
FIG. 13 is a plan view when seen from the compression surface of the piston configuring the hermetic type compressor according to the third embodiment.
Figure 14:
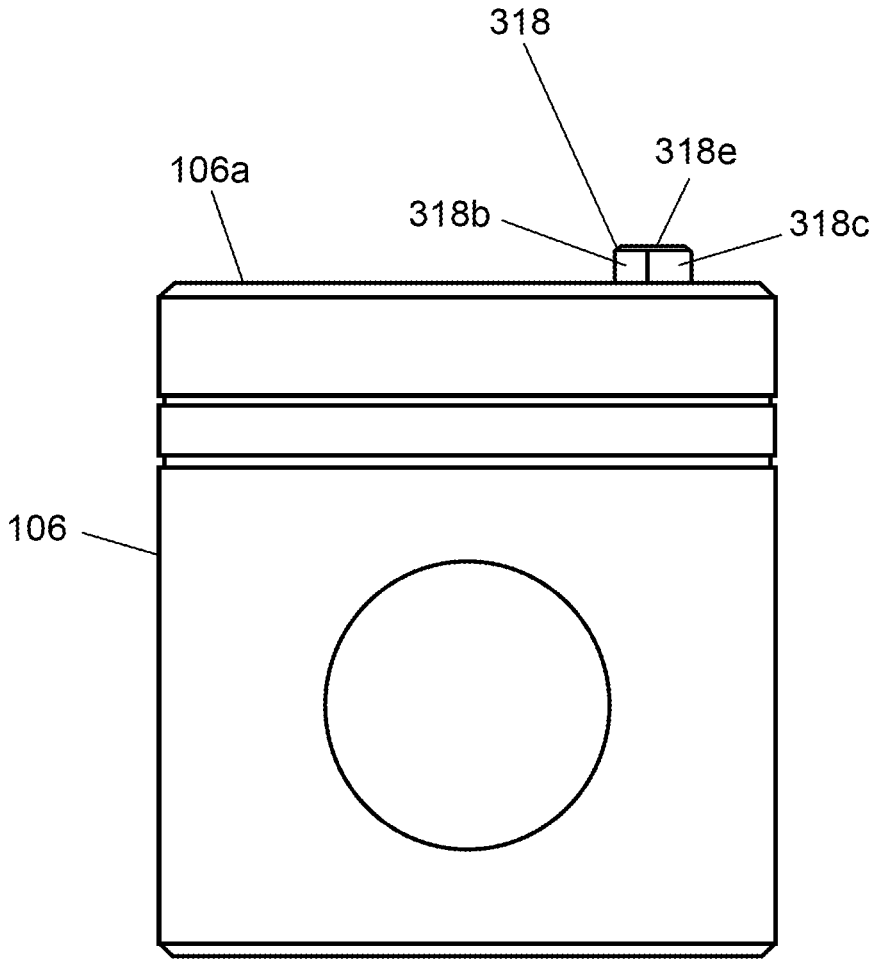
FIG. 14 is a side view of the piston configuring the hermetic type compressor according to the third embodiment.
Figure 15:
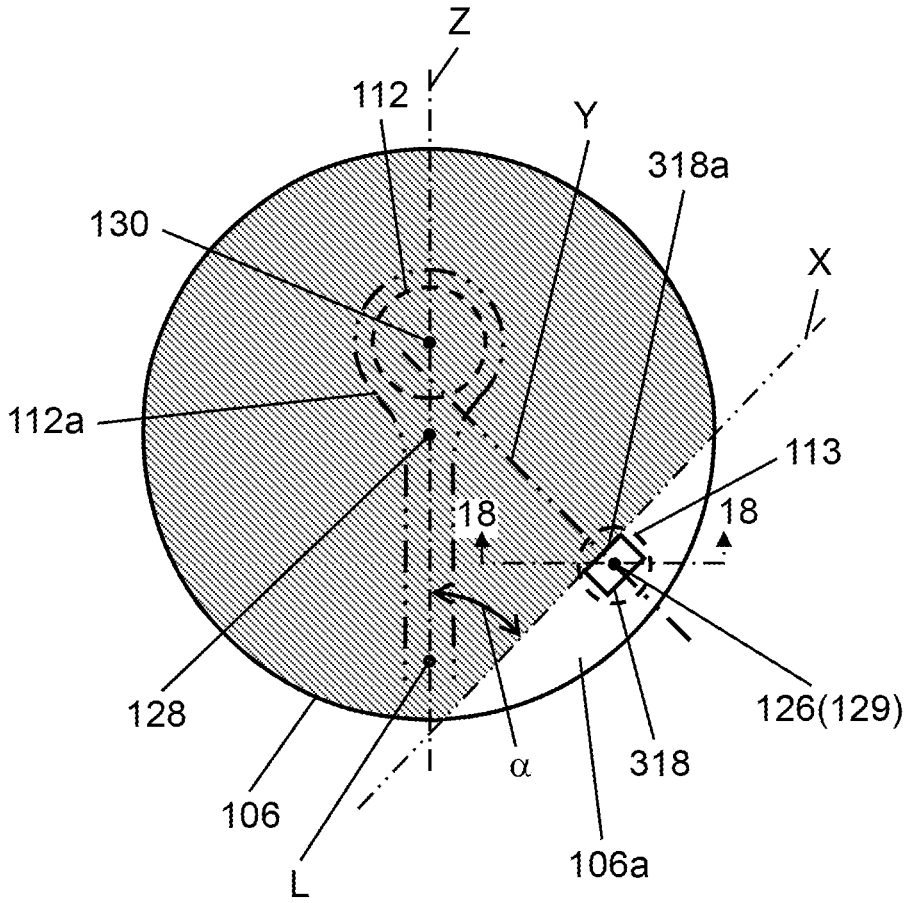
FIG. 15 is an explanatory view when seen from the compression surface of the piston showing the arrangement relationship of the suction port and the discharge port of the projection arranged in the piston.
Figure 16:
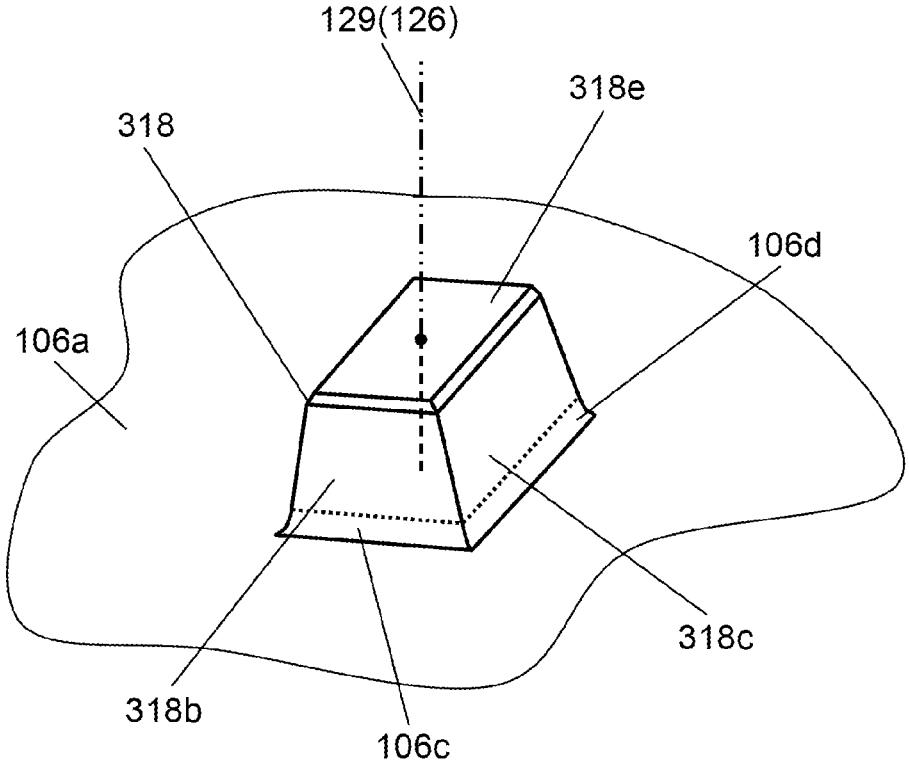
FIG. 16 is an enlarged perspective view of the projection arranged in the piston.
Figure 17:
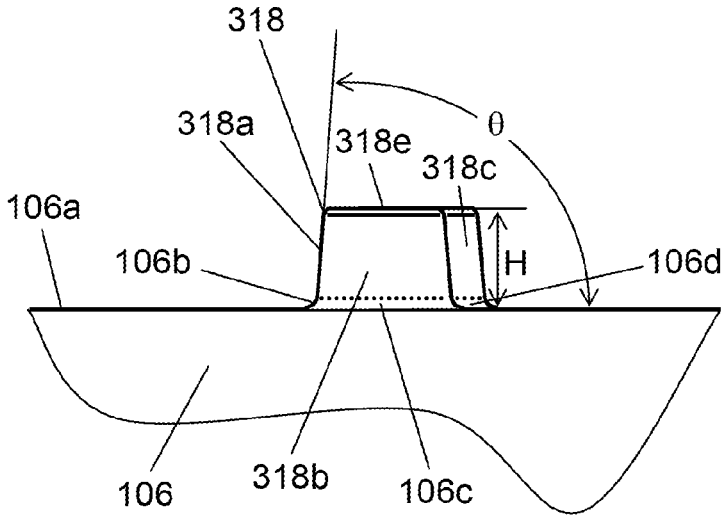
FIG. 17 is a side view of the main parts of the piston showing the side surface shape of the projection.
Figure 18:
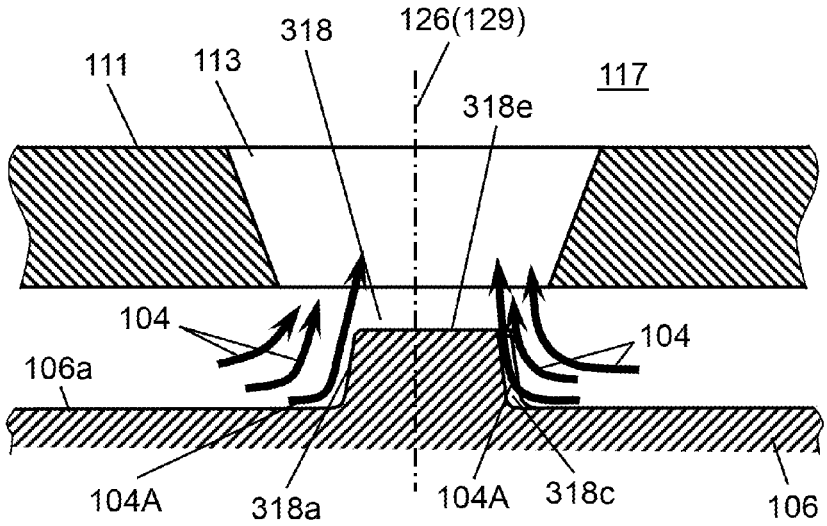
FIG. 18 is a cross-sectional view of the main parts taken along the line 18-18 of FIG. 15 describing the flow of the refrigerant gas before the termination of the compression stroke of the hermetic type compressor according to the third embodiment.
Figure 19:
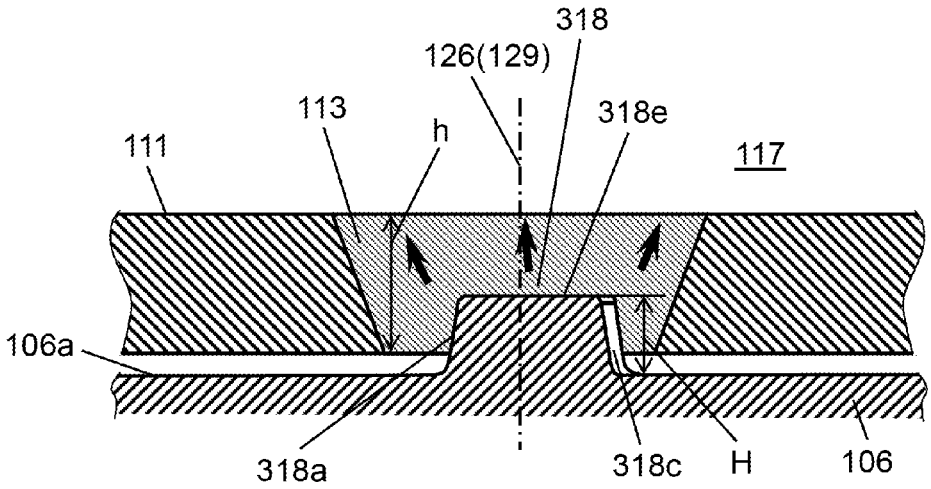
FIG. 19 is a cross-sectional view of the main parts taken along the line 19-19 of FIG. 15 describing the flow of the refrigerant gas at the termination of the compression stroke.
Figure 20:
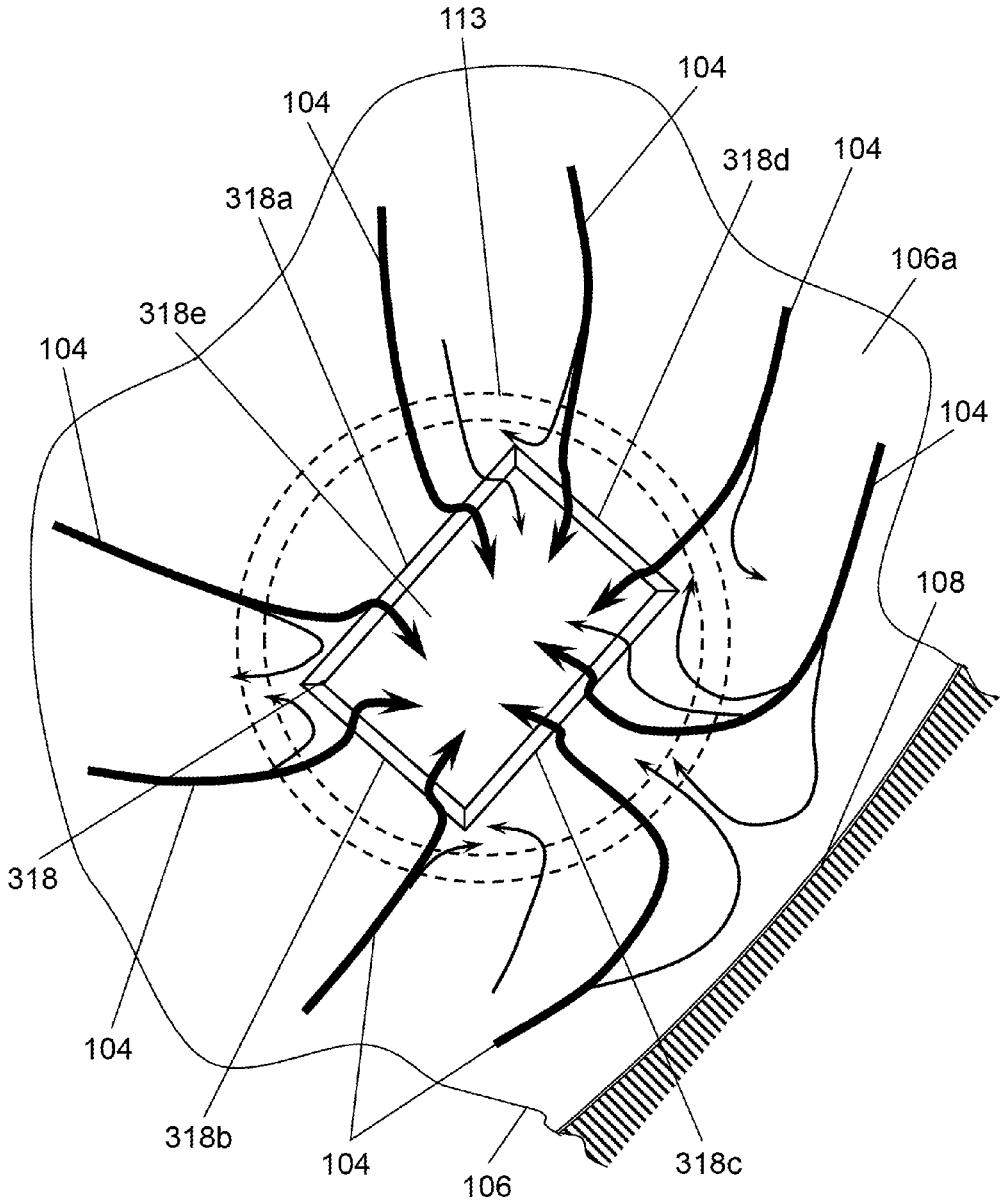
FIG. 20 is a schematic view describing the flow of the refrigerant gas of the discharge port of the hermetic type compressor according to the third embodiment.
Figure 21:
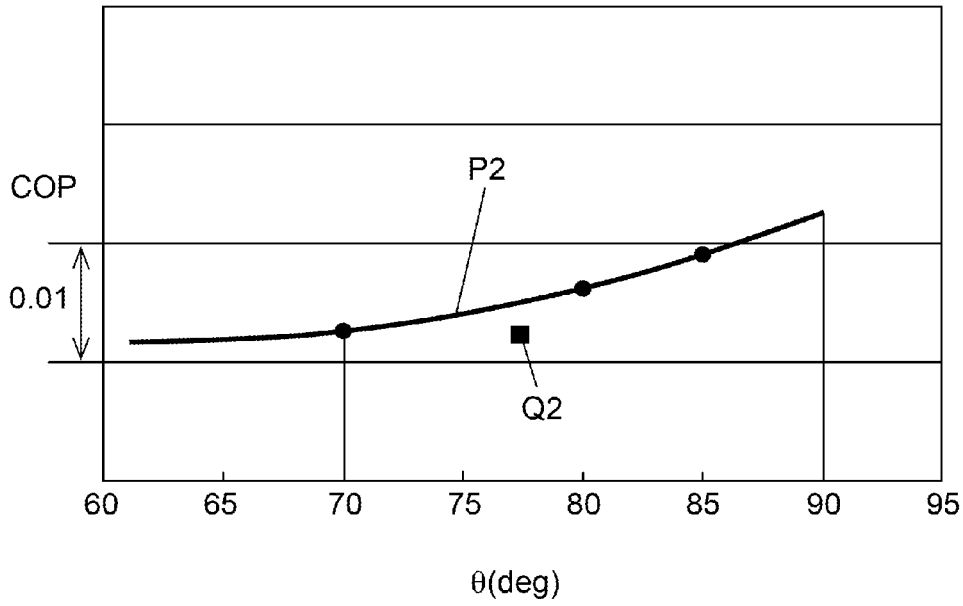
FIG. 21 is a characteristic diagram showing the relationship of the projection angle θ of the projection (side wall) arranged in the piston of the hermetic type compressor according to the third embodiment and the coefficient of performance COP.
Figure 22:
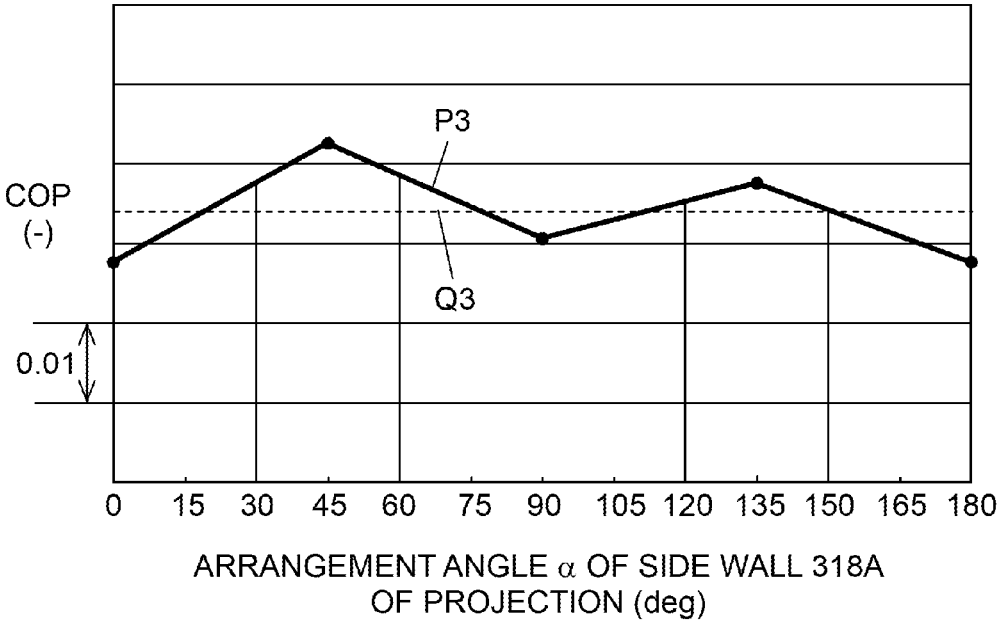
FIG. 22 is a characteristic diagram showing the relationship of the arrangement angle α of the projection (side wall) arranged in the piston of the hermetic type compressor according to the third embodiment and the coefficient of performance COP.
Figure 23:
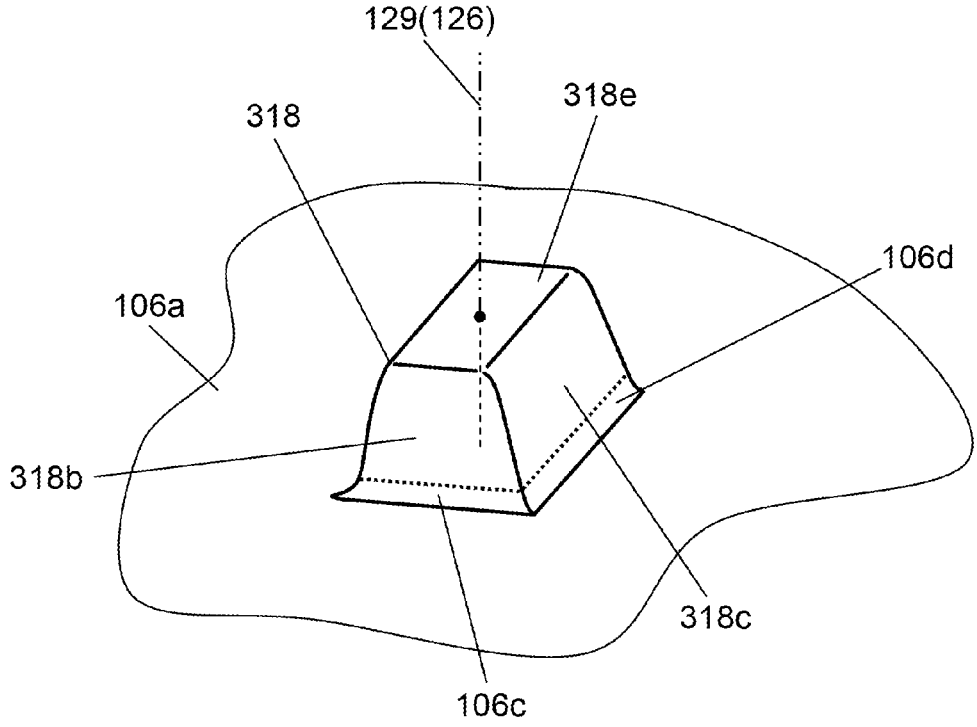
FIG. 23 is a perspective view showing a different shape of the projection arranged in the piston.

FIG. 12 is a perspective view of a piston configuring a hermetic type compressor according to a third embodiment of the present invention. FIG. 13 is a plan view when seen from the compression surface of the piston configuring the hermetic type compressor according to the third embodiment. FIG. 14 is a side view of the piston configuring the hermetic type compressor according to the third embodiment. FIG. 15 is an explanatory view when seen from the compression surface of the piston showing the arrangement relationship of the suction port and the discharge port of the projection arranged in the piston. FIG. 16 is an enlarged perspective view of the projection arranged in the piston. FIG. 17 is a side view of the main parts of the piston showing the side surface shape of the projection. FIG. 18 is a cross-sectional view of the main parts taken along the line 18-18 of FIG. 15 describing the flow of the refrigerant gas before the termination of the compression stroke of the hermetic type compressor according to the third embodiment. FIG. 19 is a cross-sectional view of the main parts taken along the line 19-19 of FIG. 15 describing the flow of the refrigerant gas at the termination of the compression stroke. FIG. 20 is a schematic view describing the flow of the refrigerant gas of the discharge port of the hermetic type compressor according to the third embodiment. FIG. 21 is a characteristic diagram showing the relationship of the projection angle $\theta$ of the projection (side wall) arranged in the piston of the hermetic type compressor according to the third embodiment and the coefficient of performance COP. FIG. 22 is a characteristic diagram showing the relationship of the arrangement angle $\alpha$ of the projection (side wall) arranged in the piston of the hermetic type compressor according to the third embodiment and the coefficient of performance COP. FIG. 23 is a perspective view showing a different shape of the projection arranged in the piston.

FIG. 1 and the content of the first embodiment are cited for the entire configuration and the description of the hermetic type compressor, and the description thereof will be omitted. The same reference numerals are denoted for the configuring elements same as the first and second embodiments, and the contents different from the first and second embodiments will be mainly described herein.

As shown in FIGS. 12 to 17, projection 318 arranged at the end face, that is, distal end face 106*a* of valve plate 111 side of piston 106 has a shape in which the rectangular solid of FIG. 8 described in the first embodiment is the base, where four flat surface (hereinafter referred to as side wall) 318*a*, 318*b*, 318*c*, 318*d* and top surface 318*e* are formed. Side walls 318*a*, 318*c* having a large area and side walls 318*b*, 318*d* having a small area adjacent to side walls 318*a*, 318*c* of projection 318 intersect at approximately 90° (include 90°). Therefore, projection 318 has a shape in which top surface 318*e* perpendicular to axial center 128 of piston 106 has a substantially rectangular (include rectangular) shape.

As shown in FIG. 15, projection 318 is at the position corresponding to discharge port 113, and appears from discharge port 113 with the reciprocating movement of piston 106. Therefore, although a slight tolerance exists, projection 318 is arranged at a position where axial center (center) 129 of projection 318 and axial center 126 of discharge port 113 (substantially) coincide. Therefore, in a state projection 318 is immersed in circular discharge port 113, the space that becomes the refrigerant passage is symmetrically formed with projection 318 as an axis.

Furthermore, the angle θ formed by four side walls 318*a*, 318*b*, 318*c*, 318*d* of projection 318 and distal end face 106*a* of piston 106 is set to approximately 90° (include 90°) as shown in FIG. 17. The angle θ slightly includes a separation gradient (angle) of the die since piston 106 and projection 318 are molded in the die, which separation gradient can be arbitrarily set. Therefore, the angle θ is defined in a range of about $70° \leqq \theta \leqq 90°$ based on the experimental result, to be described later, in the third embodiment.

As shown in FIGS. 13 and 15, one side wall 318*a* having a large area of four side walls 318*a*, 318*b*, 318*c*, 318*d* of projection 318 faces axial center (center) 128 side of piston 106. As shown in FIG. 15, the direction of side wall 318*a* is set such that the extended line X in the plane direction of side wall 318*a* is the angle α with respect to the line Z passing axial center (center) 130 of suction port 112 and axial center (center) 128 of piston 106 when seen from distal end face 106*a* side of piston 106

The definition of the angle α is an example of the positional (directional) relationship in which the line Y perpendicular to side wall 318*a* and passing the center of projection 318 (intersecting axial center 129) intersects the line Z passing axial center 130 of suction port 112 and axial center 128 of piston 106. In particular, the line Y intersects at between axial center 130 of suction port 112 and axial center 128 of piston 106 in the third embodiment.

Therefore, the angle α (about 45°) at which the extended line X of side wall 318*a* with respect to the line Z connecting axial center 130 of suction port 112 and axial center 128 of piston 106 sometimes differs according to the position of suction port 112.

Furthermore, curved surfaces 106*b*, 106*c*, 106*d* (the reference numeral is denoted only on the illustrated area) having a predetermined radius is formed at the portion (projecting portion of projection 318) where distal end face 106*a* of piston 106 and four side walls 318*a*, 318*b*, 318*c*, 318*d* of projection 318 intersect. In other words, side walls 318*a*, 318*b*, 318*c*, 318*d* of projection 318 have a shape of partially including curved surfaces 106*b*, 106*c*, 106*d*. The area of curved surfaces 106*b*, 106*c*, 106*d* (area ratio occupying side walls 318*a*, 318*b*, 318*c*, 318*d*) is set according to design data such as interval with inner diameter of discharge port 113 or area (volume of cylinder 108) of distal end face 106*a* of piston 106. The height H of projection 318 is set slightly lower than the height h (FIG. 19) of valve plate 111.

The operation and the effect of hermetic type compressor (hereinafter referred to as compressor) 100 including piston 106 configured as above will be described below. Compressor 100 is configured such that a refrigerant circuit connected with a condenser, a depressurizer, and an evaporator (all of which are not shown) is connected between the suction tube (not shown) and outlet tube 122 as well known to configure a well-known freezer cycle. R600a is adopted for refrigerant gas 104 to be compressed.

When current flows to electrical element 103, rotor 103*a* rotates thereby rotating crankshaft 109, and rotational (pivotal) movement of eccentric shaft portion 110 of crankshaft 109 is transmitted to piston 106 through connecting means 107. Therefore, piston 106 reciprocates in cylinder 108.

In the suction stroke in which piston 106 moves from an upper dead center to a bottom dead center in the reciprocating movement, the volume of compression chamber 125 increases with the movement of piston 106 to crankshaft 109 side, and hence the pressure inside compression chamber 125 lowers, suction valve 112*a* opens with the supporting point L as a base point by the pressure difference between suction chamber 116 formed in cylinder head 114 and the interior of compression chamber 125, and compression chamber 125 and suction chamber 116 communicate through suction port 112. Therefore, refrigerant gas 104 is guided to hermetic vessel 101 from the freezer cycle (not shown), and taken into compression chamber 125 through suction muffler 115, suction chamber 116, and suction port 112.

Therefore, refrigerant gas 104 is guided to hermetic vessel 101 from the refrigerant circuit, and taken into compression chamber 125 sequentially passing suction muffler 115, suction chamber 116, and suction port 112.

In the compression stroke in which piston 106 moves from the bottom dead center to the upper dead center, suction valve 112*a* closes suction port 112 with the movement of piston 106 towards valve plate 111 side, and the volume of the interior of compression chamber 125 reduces. Accompanied therewith, refrigerant gas 104 in compression chamber 125 is compressed, and the pressure in compression chamber 125 rises. When the pressure in compression chamber 125 rises to the pressure in discharge chamber 117, the discharge valve (not shown) opens by the pressure difference between of discharge chamber 117 and the interior of compression chamber 125, and compressed refrigerant gas 104 is discharged from discharge port 113 to discharge chamber 117 in cylinder head 114 until piston 106 reaches the upper dead center. Refrigerant gas 104 discharged to discharge chamber 117 passes discharge tube 121 and is sent to the refrigerant circuit at the exterior of hermetic vessel 101 from outlet tube 122, thereby forming the freezer cycle. Each stroke of suction, compression, and discharge is repeatedly carried out for every rotation of crankshaft 109, and refrigerant gas 104 circulates through the refrigerant circuit (freezer cycle).

The flow of refrigerant gas 104 discharged from discharge port 113 near the termination of the discharge stroke will be described in detail with reference to FIGS. 18 and 19. For the sake of convenience, the discharge stroke will be described as contained in the compression stroke based on the movement direction of piston 106.

As shown in FIG. 18, when the volume of compression chamber 125 reduces in the last half of the compression stroke, distal end face 106*a* of piston 106 approaches valve plate 111, and at the same time, projection 318 approaches opposing discharge port 113. The discharge valve opens with rise in pressure in compression chamber 125. At the same time as when the discharge valve opens, refrigerant gas 104 compressed in compression chamber 125 is discharged all at once to discharge chamber 117 in cylinder head 114 through discharge port 113, as shown with an arrow in the figure.

As the compression stroke advances, projection 318 of piston 106 enters opposing discharge port 113 as shown in FIG. 19, and the compression stroke is terminated leaving one part of compressed refrigerant gas 104 in a dead volume (microscopic hatched portion) formed by projection 118 and discharge port 113 and in a microscopic interval space between valve plate 111 and distal end face 106*a* of piston 106.

The flow of refrigerant gas 104 in compression chamber 125 in the compression stroke is the three-dimensional flow in which the speed as well as the flow direction greatly change, and shows a complicating behavior.

In the third embodiment, projection 318 arranged at distal end face 106*a* of piston 106 has a shape in which a rectangular solid with four side walls 318*a*, 318*b*, 318*c*, 318*d* is the base, and thus refrigerant gas 104 is less likely to go around the periphery of projection 318.

Therefore, as shown in FIG. 19, the flow path of refrigerant gas 104 formed with discharge port 113 and projection 318 becomes narrow and the flow speed of refrigerant gas 104 becomes fast particularly near the termination of the compression stroke. Refrigerant gas 104 flowing to discharge port 113 is considered to flow in the direction towards discharge port 113 along each side wall 318*a*, 318*b*, 318*c*, 318*d*.

In other words, as shown in FIGS. 13 and 20, refrigerant gas 104 flowing along the outer shape of piston 106 (inner wall of cylinder 108) has the flow of direction thereof blocked mainly by side walls 318*b*, 318*d* of projection 318, where the flow component guided to discharge port 113 is assumed to increase, although turbulent flow is assumed, at the corner of side walls 318*a*, 318*c* adjacent to side walls 318*b*, 318*d*.

Regarding refrigerant gas 104 that went around to side wall 318*c* side of projection 318, the flow thereof collides from both sides, where one part is assumed to be guided to discharge port 113 along side wall 318*c*.

Furthermore, regarding refrigerant gas 104 flowing from suction port 112 to discharge port 113, the flow in the relevant direction is similarly blocked by side wall 318*a*, and the flow component guided to discharge port 113 by side wall 318*a* is assumed to increase.

Furthermore, the projecting portion of projection 318 at distal end face 106*a* of piston 106 becomes curved surfaces 106*b*, 106*c*, 106*d*, and the effect of smoothing the flow of refrigerant gas 104 along each side wall 318*a*, 318*b*, 318*c*, 318*d* can be expected.

The present invention has an effect of reducing the volume of the dead volume formed by projection 318 and discharge port 113 to enhance the efficiency of hermetic type compressor 100 in the flow of refrigerant gas 104. Furthermore, in addition to the influence of the shape of projection 318, it is experimentally found that the angle θ (FIG. 17) formed by distal end face 106*a* of piston 106 at projection 318 and at least side wall 318*a*, and direction of side wall 318*a* of projection 318, that is, the angle (arrangement angle) α (FIG. 15) formed by the extended line X of side wall 318*a* with respect to the line Z connecting axial center (center) 130 of suction port 112 and axial center (center) 128 of piston 106 also influence.

The effects involved in the shape of projection 318 of piston 106 will be described below. FIG. 21 is a characteristics diagram showing the result of measuring the relationship of the angle θ and the efficiency for compressor 100 having the above configuration. The horizontal axis is the angle θ formed by side wall 318*a* closest to axial center 130 of suction port 112 at projection 318 of piston 106 and distal end face 106*a* of piston 106, and the vertical axis is the coefficient of performance COP. In FIG. 21, a solid line P2 shows the characteristics of a hermetic type compressor of the present embodiment. A dotted line Q2 shows the characteristics of the conventional hermetic type compressor.

As shown in FIG. 21, when projection 318 of piston 106 has a cross-sectional shape substantially parallel to distal end face 106*a* of piston 106 of a substantially rectangle, and the angle formed by side wall 318*a* closest to axial center 130 of suction port 112 at projection 318 and distal end face 106*a* of piston 106 is θ, the range of about $70° \leqq \theta \leqq 90°$ is experimentally recognized to obtain higher efficiency than the conventional hermetic type compressor 20 including projection 14 of circular column (circular truncated cone) shape. Namely, in case that the angle θ is out of this range, it is not expect to obtain higher efficiency than the conventional hermetic type compressor 20.

The experimental effect of the angle θ shown in FIG. 21 will now be inferred. In other words, when the shape of projection 318 is a rectangular solid shape rather than a circular column (circular truncated cone) shape, by setting the angle θ with distal end face 106*a* of piston 106 of side wall 318*a* facing suction port 112 and having a large area of four side walls 318*a*, 318*b*, 318*c*, 318*d* of projection 318 of piston 106 to about $70° \leqq \theta \leqq 90°$, refrigerant glow 104A that goes around to side walls 318*b*, 318*c* of projection 318 is assumed to differ from the case of the circular column shape.

Specifically, in the case of projection 318 of the third embodiment, refrigerant flow 104A hits projection 318, as shown in FIG. 18. However, as projection 318 includes four side walls 318*a*, 318*b*, 318*c*, 318*d*, which are flat surfaces and has a shape in which the rectangular solid is the base, the effect of guiding the disturbed flow of refrigerant gas 104 flowing to discharge port 113 in a constant direction, that is, the axial direction of discharge port 113 is involved. In particular, when the angle θ with distal end face 106*a* of piston 106 of side wall 318*a* facing suction port 112 and having a large area is set in a range of about $70° \leqq \theta \leqq 90°$, refrigerant flow 104A of projection 318 is assumed to have greater flow component guided in the direction of discharge port 113 than in the case of circular column shape.

In other words, the loss that occurs when the flow is disturbed is reduced in refrigerant flow 104 that hit side wall 318*a* (318*b*, 318*c*, 318*d*) of projection 318 closest to suction port 112 where the flow speed of refrigerant gas 104 is assumed to be fast. Accompanied therewith, the flow of refrigerant gas 104 is further rectified, the amount of refrigerant gas 104 accumulating in compression chamber 125 is reduced, and the suction loss involved in the re-expansion of refrigerant gas 104 accumulated immediately before the start of suction stroke is reduced. As a result, effect is assumed to be found in the reduction of the electrical input of compressor 100 (enhancement of the coefficient of performance COP).

This experimental result proves that the angle θ formed by side wall 318*a* closest to axial center 130 of suction port 112 of four side walls 318*a*, 318*b*, 318*c*, 318*d* and distal end face 106*a* of piston 106 also influences efficiency in addition to the volume of the dead volume, the shape of discharge port 113, and the shape of projection 318 of piston 106.

The experiment of FIG. 21 is a review on only the angle θ of one side wall 318*a*. However, effects of further enhancing the coefficient of performance COP can be expected by similarly setting the angle θ of three remaining side walls 318*b*, 318*c*, 318*c* in the range of about $70° \leqq \theta \leqq 90°$.

Projection 318 of rectangular solid shape has difference in the effect of enhancing the efficiency depending on the operation frequency, as described in the second embodiment. However, it is experimentally recognized that the efficiency of compressor 100 enhances in the entire frequency range of the power supply frequency (operation frequency) of between about 45 Hz and 60 Hz, that is, in the operation frequency condition generally operated in the home refrigerator.

Therefore, further energy saving can be expected in compressor 100 according to the third embodiment adopting the setting of the angle θ of side wall 318*a* (318*b*, 318*c*, 318*d*) of projection 318 and the inverter drive control by the operation frequency including 50 Hz and 60 Hz.

The effects of the arrangement angle α of projection 318 will now be described. FIG. 22 is a characteristics diagram showing the result of measuring the relationship between the arrangement angle α of projection 318 and the efficiency for compressor 100 having the above configuration. The horizontal axis is the arrangement angle α formed by the extended line X of the surface of side wall 318*a* facing axial center 128 side of piston 106 with respect to the line Z passing axial center (center) 130 of suction port 112 and axial center (center) 128 of piston 106, and the vertical axis is the coefficient of performance COP. Side walls 318*a*, 318*c* having a large area and adjacent side walls 318*b*, 318*d* having a small area of projection 318 intersect at substantially 90°.

The content of FIG. 22 is the result of performing angle setting at a plurality of areas in a range of between 0° (parallel to the line Z passing axial center 130 of suction port 112 and axial center of piston 106) to 180° (parallel to the line Z where side wall 318*c* faces suction port 112 side) for the direction (arrangement angle α) of side wall 318*a* closes to axial center 124 of compression chamber 125 (axial center 128 of piston 106) and having the widest area of four side walls 318*a*, 318*b*, 318*c*, 318*d* of projection 318, and measuring the coefficient of performance COP for every set state. In FIG. 22, a solid line P3 shows the characteristics of a hermetic type compressor of the present embodiment. A dotted line Q3 shows the characteristics of the conventional hermetic type compressor.

According to the experiment, when the arrangement angle α is in a range of between about 20° to about 75°, as shown with the solid line P3 of FIG. 22, the efficiency (coefficient of performance COP) higher than conventional hermetic type compressor 20 shown with the dotted line Q3 is obtained with about 45° as the peak. Furthermore, when the arrangement angle α is in a range of between about 118° and about 150°, the efficiency (coefficient of performance COP) higher than conventional hermetic type compressor 20 with about 135° as the peak is obtained.

The numerical value of the arrangement angle α is the result of setting the arrangement angle α of projection 318 assuming axial center 130 of suction port 112 at distal end face 106*a* of piston 106, and a slight tolerance is assumed to be created in the angle numerical value when incorporated as compression element 102.

Therefore, from the above results, the efficiency higher than conventional hermetic type compressor 20 adopting projection 14 of circular column shape is expected to be obtained by arranging the direction (arrangement angle α) of side wall 318*a* closest to axial center 124 of compression chamber 125 of projection 318 and having the widest area in an angle in the range of about 15°≦α≦about 75° and about 105°≦α≦about 150° with respect to the line Z passing axial center 130 of suction port 112 and the axial center of piston 106.

According to such result, the loss that occurs when the flow is disturbed is reduced in refrigerant flow 104A that hit side wall 318*a* (318*b*, 318*c*, 318*d*) of projection 318 closest to suction port 112 where the flow speed of refrigerant gas 104 is assumed to be fast. Accompanied therewith, the flow of refrigerant gas 104 is further rectified, the amount of refrigerant gas 104 accumulating (remaining) in compression chamber 125 is reduced, and the suction loss involved in the re-expansion of refrigerant gas 104 accumulated immediately before the start of suction stroke is reduced. As a result, effect is assumed to be found in the reduction of the electrical input of compressor 100 (enhancement of the coefficient of performance COP).

This experimental result proves that the angle (arrangement angle) α formed by side wall 318*a* closest to axial center 130 of suction port 112 in projection 318 and having the widest area the line Z passing axial center 130 of suction port 112 and axial center 128 of piston 106 also influences efficiency in addition to the volume of the dead volume, the shape of discharge port 113, and the shape of projection 318 of piston 106 (angle θ formed by side wall 318*a* closest to axial center 130 of suction port 112 and distal end face 106*a* of piston 106).

The experimental results shown in FIG. 22 will be inferred below. In other words, similar to the review of the angle θ formed by side wall 318*a* closest to axial center 130 of suction port 112 and distal end face 106*a* of piston 106 side wall 318*a* closest to axial center 124 of compression chamber 125 (axial center of piston 106) and having the widest area inhibits the flow of refrigerant gas 104 that goes around other side walls 318*b*, 318*c* (318*d*) of projection 318 in refrigerant gas 104 flowing with complicating behavior through compression chamber 125, and it is assumed that the flow of refrigerant gas 104 different from the case of the circular column shape of the prior art is the main factor in the enhancement of the efficiency.

Specifically, as shown in FIG. 13 and FIG. 20, although turbulent flow is assumed at the corner of side walls 318*b*, 318*d* adjacent to side wall 318*a* when refrigerant gas 104 hits side wall 318*a*, flow towards discharge port 113 is generated by each side wall 318*a*, 318*b*, 318*d*, and the effect of rectifying the flow of refrigerant gas 104 involving complicating behavior is assumed to be involved. Regarding refrigerant gas 104 that went around to side wall 318*c* side of projection 318, the flow thereof collides from both sides, where one part is assumed to be guided to discharge port 113 along side wall 318*c*.

In particular, when the arrangement angle α of side wall 318*a* of projection 318 is about 45°, the effect of guiding the refrigerant flow to discharge port 113 by each side wall 318*a*, 318*b*, 318*c*, 318*d* is most effectively performed. Furthermore, the effect of guiding the refrigerant flow to discharge port 113 by each side wall 318*a*, 318*b*, 318*c*, 318*d* is assumed to be effectively performed even when the arrangement angle is about 145° further advanced from 90°.

Therefore, the loss that occurs when the flow is disturbed is reduced in refrigerant gas 104 that hit side wall 318*a* of projection 318 closest to axial center 124 of compression chamber 125 where the flow speed of the refrigerant is assumed to be fast, and the flow of refrigerant gas 104 is further rectified, which is assumed to lead to alleviation of the compression load.

From the above review, the shape of projection 318 is not limited to a square column (truncated pyramid) shape formed by a plurality of flat surfaces, and similar effects can be expected even with a polygonal column such as a triangular column (triangular pyramid) and a polygonal column (polygonal pyramid) shape having a plurality of flat surfaces as long as the effect of guiding refrigerant gas 104 that goes around the peripheral wall of projection 318 towards discharge port 113 can be expected.

Side walls 318*a*, 318*b*, 318*c*, 318*d* of projection 318 do not require a complete flat surface, and may be a flat surface that gradually curves in a direction axial center 126 of discharge port 113 (axial center 129 of projection 318) extends. Similarly, the effect of suppressing refrigerant gas 104 from going around to side walls 318*a*, 318*b*, 318*c*, 318*d* of projection 318 can be expected, and similarly, the effect of enhancing the efficiency can be expected.

Moreover, the arrangement angle α at which the effect can be expected the most is about 45° for side wall 318*a* (318*c*) having a wide area according to the experimental result shown in FIG. 22. This is assumed to be the consequence of rectifying the flow with which the effect is obtained the most of refrigerant gas 104 from suction port 112, that is, the main flow of refrigerant gas 104.

In other words, the experimental result shown in FIG. 22 proves that the effect of enhancing the efficiency can be expected even with the configuration of projection 118 described in the first embodiment by setting the optimum arrangement angle α of at least one flat surface (side wall 318*a* in the third embodiment) of projection 318, that is, the arrangement angle α (about 45° in the third embodiment) at which the main flow of refrigerant gas 104 towards discharge port 113 can be rectified.

Furthermore, as axial center 129 of projection 318 is arranged to substantially coincide with axial center 126 of discharge port 113, the passage of refrigerant gas 104 formed by projection 318 in discharge port 113 can be formed symmetric with projection 318 as an axis, which is also assumed to occur from efficiency enhancement.

In other words, when the position of projection 318 is shifted from axial center 126 of discharge port 113, a flow-out patch of gas involved in the shifted passage area generates thereby disturbing the flow of discharging refrigerant gas 104, but the flow of discharging refrigerant gas 104 is made natural by forming the passage of refrigerant gas 104 symmetric with projection 318 as an axis, and accumulation (remaining) of refrigerant gas 104 in compression chamber 125 can be reduced. Therefore, the suction loss involved in the re-expansion of refrigerant gas 104 accumulated in compression chamber 125 can be further reduced, and the input of compressor 100 can be reduced.

Discharge port 113 arranged in valve plate 111 is formed so that the cross-sectional area increases from compression chamber 125 side towards the opposite side (discharge chamber 117) of compression chamber 125, but the effect of enhancing efficiency can be expected even with cylindrical discharge port 113 having a uniform radius compared to conventional hermetic type compressor 20.

The configuration of projection 318 of the third embodiment enables further enhancement of the efficiency and obtains compressor of high coefficient of performance COP by the setting of the arrangement angle α (about $15° \leqq \alpha \leqq 75°$ or about $105° \leqq \alpha \leqq 150°$) of projection 318 in addition to the setting of the angle θ (about $70° \leqq \theta\alpha \leqq 90°$) of side wall 318*a* (318*b*, 318*c*, 318*d*) of projection 318 and the effect of enhancing the efficiency involved in the inverter drive control by the operation frequency including 50 Hz, 60 Hz described in the second embodiment.

Fourth Exemplary Embodiment

Figure 24:
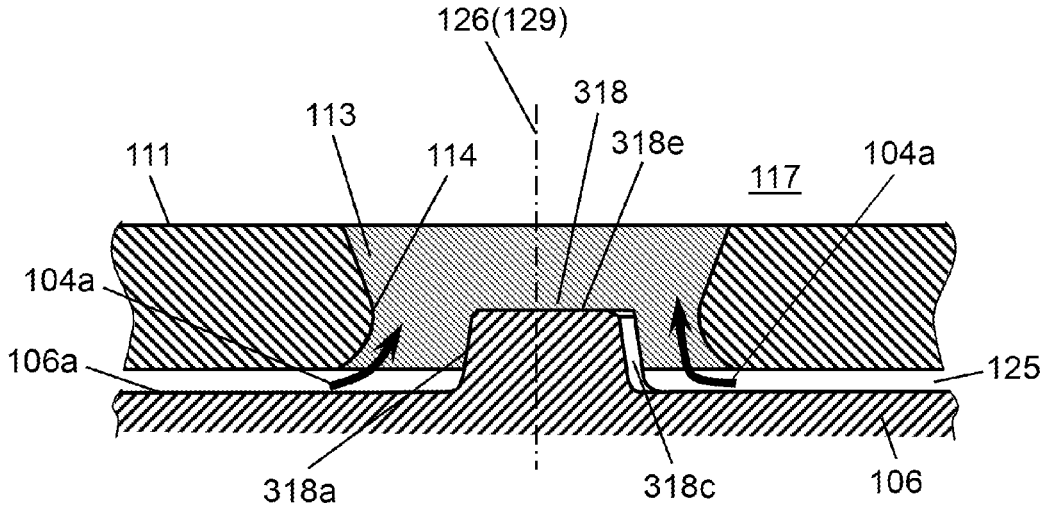
FIG. 24 is a cross-sectional view of the main parts taken along the line 24-24 of FIG. 15 describing the flow of the refrigerant gas at the termination of the compression stroke of a discharge port of a hermetic type compressor according to a fourth embodiment.

FIG. 24 is a cross-sectional view of the main parts taken alone line 24-24 of FIG. 15 describing the refrigerant gas flow in time of the termination of the compression stroke of the discharge port of a hermetic type compressor according to a fourth embodiment.

FIG. 1 and the content of the first embodiment are cited for the entire configuration and the description of the hermetic type compressor, and the description thereof will be omitted. The same reference numerals are denoted for the configuring elements same as the third embodiment, and the contents different from the third embodiment will be mainly described herein. The configuration different from the third embodiment is the configuration of discharge port 113 arranged in valve plate 111.

In other words, the configuration in which bell-mouth portion 114 having an arcuate cross-section is formed at the peripheral edge of the inlet side (compression chamber 125 side) of discharge port 113 differs from the third embodiment. The radius of the circular arc of bell-mouth portion 114 can be arbitrarily set.

The operation and the effect of compressor 100 including valve plate 111 configured as above will be described below. Compressor 100 is configured such that a refrigerant circuit connected with a condenser, a depressurizer, and an evaporator (all of which are not shown) is connected between the suction tube (not shown) and outlet tube 122 as well known to configure a well-known freezer cycle. R600a is adopted for refrigerant gas 104 to be compressed.

When current flows to electrical element 103, rotor 103*a* rotates thereby rotating crankshaft 109, and rotational (pivotal) movement of eccentric shaft portion 110 of crankshaft 109 is transmitted to piston 106 through connecting means 107. Therefore, piston 106 reciprocates in cylinder 108.

In the suction stroke in which piston 106 moves from an upper dead center to a bottom dead center in the reciprocating movement, the volume of compression chamber 125 increases with the movement of piston 106 to crankshaft 109 side. Thus, the pressure inside compression chamber 125 lowers, suction valve 112*a* opens with the supporting point L as a base point by the pressure difference between suction chamber 116 formed in cylinder head 114 and the interior of compression chamber 125, and compression chamber 125 and suction chamber 116 communicate through suction port 112.

Therefore, refrigerant gas 104 is guided to hermetic vessel 101 from the freezer cycle (not shown), and taken into compression chamber through suction muffler 115, suction chamber 116, and suction port 112. Therefore, refrigerant gas 104 is guided to hermetic vessel 101 from the refrigerant circuit, and taken into compression chamber 125 sequentially passing suction muffler 115, suction chamber 116, and suction port 112.

In the compression stroke in which piston 106 moves from the bottom dead center to the upper dead center, suction valve 112*a* closes suction port 112 with the movement of piston 106 towards valve plate 111 side, and the volume of the interior of compression chamber 125 reduces. Accompanied therewith, refrigerant gas 104 in compression chamber 125 is compressed, and the pressure in compression chamber 125 rises.

When the pressure in compression chamber 125 rises to the pressure in discharge chamber 117, the discharge valve (not shown) opens by the pressure difference between discharge chamber 117 and the interior of compression chamber 125, and compressed refrigerant gas 104 is discharged from discharge port 113 to discharge chamber 117 in cylinder head 114 until piston 106 reaches the upper dead center.

Refrigerant gas 104 discharged to discharge chamber 117 passes discharge tube 121 and is sent to the refrigerant circuit at the exterior of hermetic vessel 101 from outlet tube 122, thereby forming the freezer cycle. Each stroke of suction, compression, and discharge is repeatedly carried out for every rotation of crankshaft 109, and refrigerant gas 104 circulates through the refrigerant circuit (freezer cycle).

The flow of refrigerant gas 104 discharged from discharge port 113 in the discharge stroke will be described in detail with reference to FIG. 24 with the help of FIG. 18. For the sake of convenience, the discharge stroke will be described as contained in the compression stroke based on the movement direction of piston 106.

As shown in FIG. 18, when the volume of compression chamber 125 reduces in the last half of the compression stroke, distal end face 106*a* of piston 106 approaches valve plate 111, and at the same time, projection 318 approaches opposing discharge port 113. The discharge valve opens with rise in pressure in compression chamber 125. At the same time as when the discharge valve opens, refrigerant gas 104 compressed in compression chamber 125 is discharged all at once to discharge chamber 117 in cylinder head 114 through discharge port 113, as shown with an arrow in the figure.

As the compression stroke advances, projection 318 of piston 106 enters opposing discharge port 113 as shown in FIG. 24, and the compression stroke is terminated leaving one part of compressed refrigerant gas 104 in a dead volume (microscopic hatched portion) formed by projection 118 and discharge port 113 and in a microscopic interval space between valve plate 111 and distal end face 106*a* of piston 106.

The flow of refrigerant gas 104 in compression chamber 125 in the compression stroke is the three-dimensional flow in which the speed as well as the flow direction greatly change, and shows a complicating behavior.

In the fourth embodiment, bell-mouth portion 114 having an arcuate cross-section is arranged at the peripheral edge on the inlet side of discharge port 113, so that refrigerant gas 104 is smoothly guided towards discharge port 113, and the loss at the inlet portion of discharge port 113 can be improved.

In other words, as described in the third embodiment, refrigerant gas 104 rectified in the axial direction of discharge port 113 by side wall (flat surface) 318*a*, 318*b*, 318*c*, 318*d* of projection 318 easily flows along the circular arc of bell-mouth portion 114, and smoothly passes discharge port 113. In other words, since the flow of refrigerant gas 104 is smoothened by the synergetic effect of projection 318 and bell-mouth portion 114, the accumulation in compression chamber 125 at the termination of the compression stroke is reduced. Therefore, the re-expansion loss involved in the accumulation of refrigerant gas 104 can be reduced and the input of compressor 100 can be reduced in addition to the effect of reducing the dead volume in discharge port 113.

Fifth Exemplary Embodiment

Figure 25:
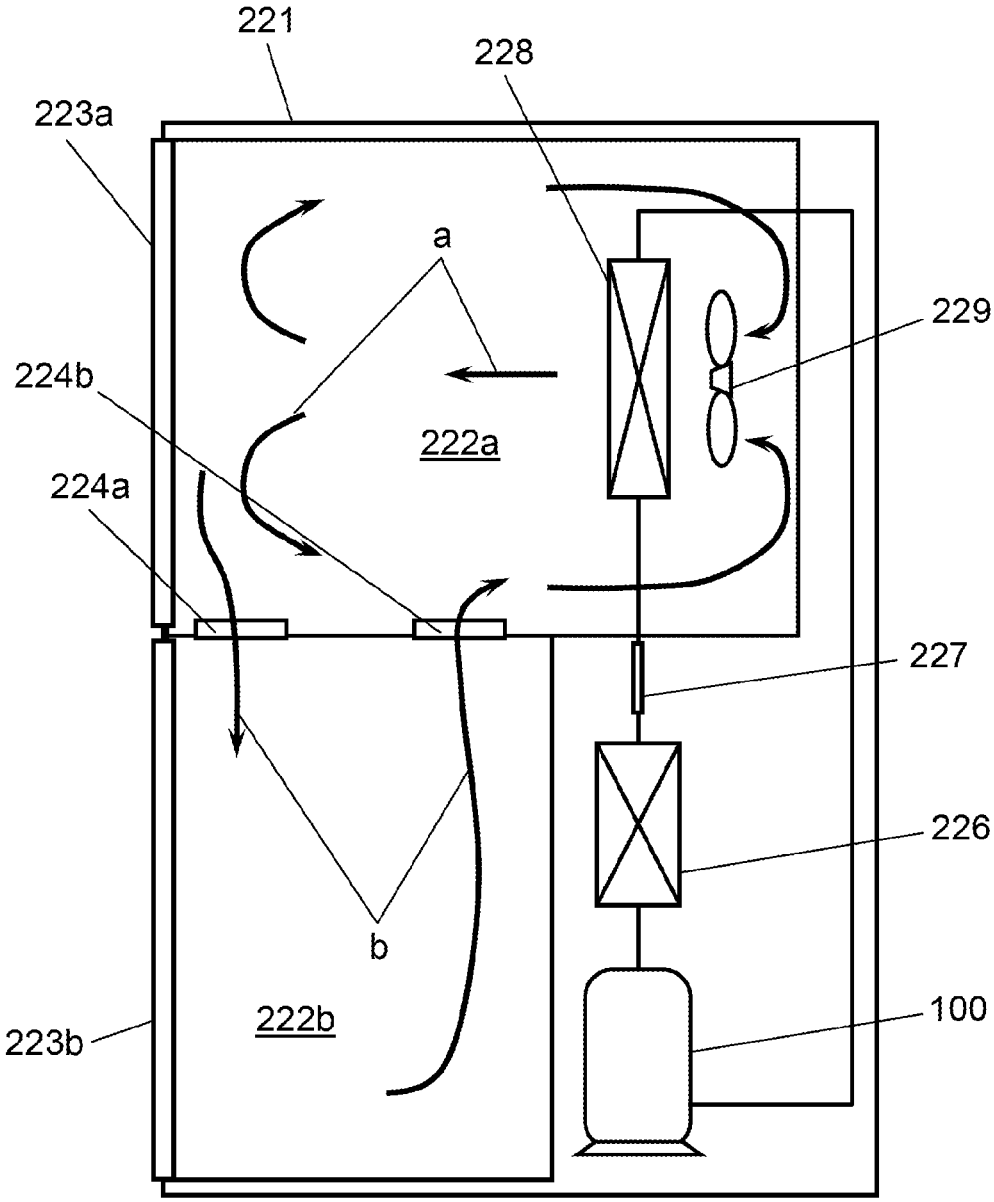
FIG. 25 is a schematic view showing a configuration of an article storage device according to the fourth embodiment of the present invention.
Figure 26:
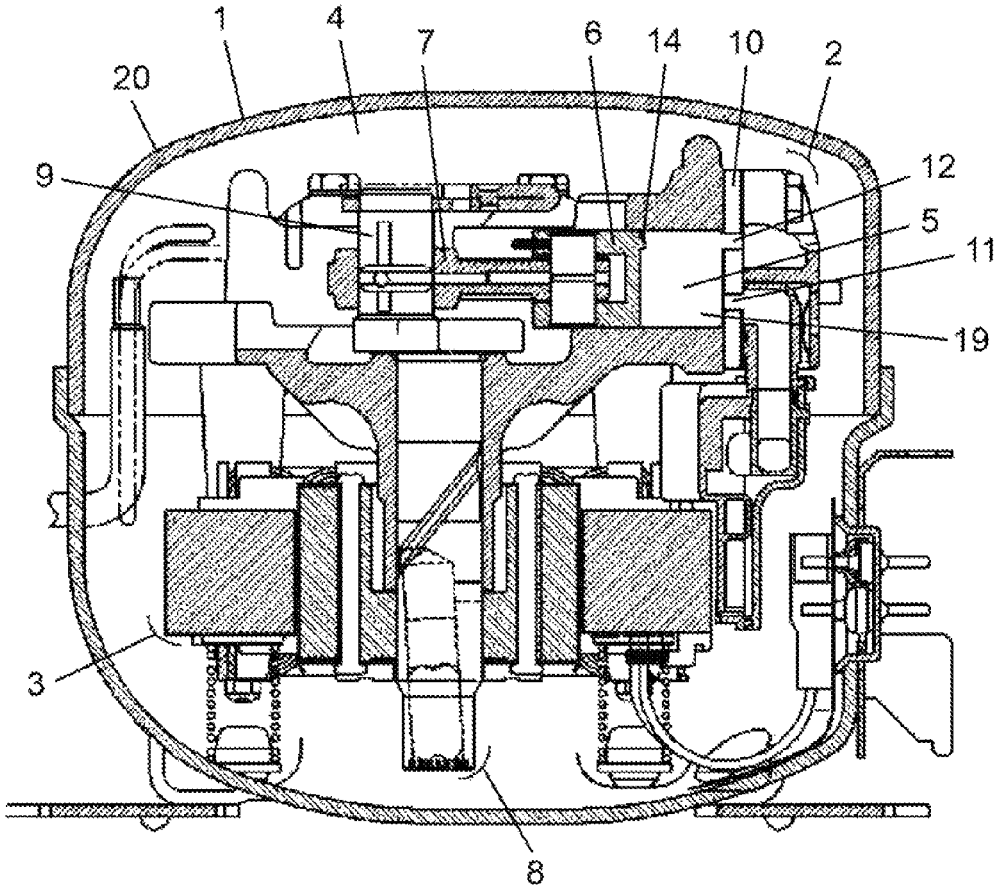
FIG. 26 is a longitudinal cross-sectional view of a conventional hermetic type compressor.
Figure 27:
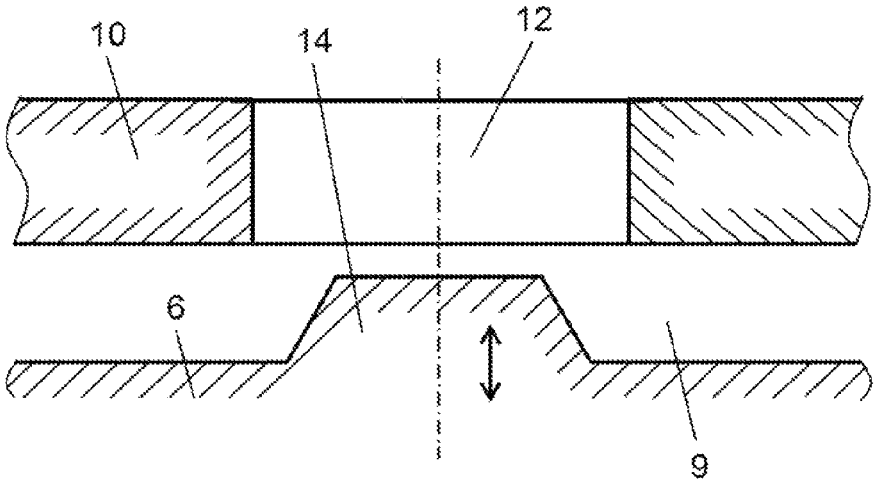
FIG. 27 is a cross-sectional view of the main parts of the conventional hermetic type compressor.
Figure 28:
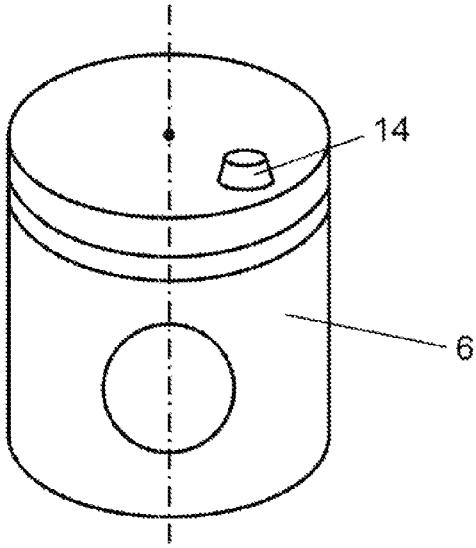
FIG. 28 is a perspective view of a piston of the conventional hermetic type compressor.

FIG. 25 is a schematic view showing a configuration of an article storage device according to a fifth embodiment of the present invention. A configuration in which hermetic type compressor 100 of the third embodiment is incorporated in the freezer cycle sealed with refrigerant R600a will be described here.

In FIG. 25, storage device main body 221 includes first storage chamber 222*a* and second storage chamber 222*b* both having the front surface opened to the interior and being surrounded by a heat insulating material, where first door 223*a* and second door 223*b* having a heat insulating property for opening and closing the opening are arranged on the front surface in correspondence to first storage chamber 222*a* and second storage chamber 222*b*. First storage chamber 222*a* and second storage chamber 222*b* communicate through communication passages 224*a*, 224*b*.

Furthermore, a freezer cycle in which hermetic type compressor 100 of the third embodiment, condenser 226, depressurizer 227, and evaporator 228 are annularly coupled by a piping is arranged inside storage device main body 221. Evaporator 228 is arranged in first storage chamber 222*a*. Blower 229 for actively circulating the cold air cooled by evaporator 228 in first storage chamber 222*a* as shown with an arrow a is arranged in first storage chamber 222*a*. Second storage chamber 222*b* is cooled by the circulation of the cold air of one part of first storage chamber 222*a* that flowed in through communication passages 224*a*, 224*b* as shown with an arrow b.

Therefore, as described in the third embodiment, the article storage device can perform an efficient cooling operation by the mounting of high efficiency hermetic type compressor 100. Accompanied therewith, the article storage device in which the power consumption (amount) is suppressed can be obtained.

As described above, the hermetic type compressor according to the present invention is an inexpensive hermetic type compressor having high efficiency while ensuring high productivity. Therefore, application can be made to the hermetic type compressor to be used in the freezer cycle, and it can be widely mounted to the freezer unit. The article storage device mounted with the relevant hermetic type compressor can be developed to various types of devices such as a dehumidification device, a showcase, and a vending machine including a home refrigerator, and application can be widely made as the storage device in which the power consumption is suppressed.

As described above, the hermetic type compressor of the present invention includes an electrical element and compression element driven by the electrical element in the hermetic vessel, where the compression element includes a cylinder block having a compression chamber space, a piston that reciprocates within the compression chamber, and a valve plate being arranged at the end of the compression chamber space and forming the compression chamber with the piston, the valve plate includes the suction port to which the gas to be compressed in the compression chamber flows in and the discharge port from which the gas compressed in the compression chamber is discharged, a projection that appears from the discharge port with the reciprocating movement of the piston is arranged at the distal end face of the piston and at the position facing the discharge port, and the projection includes a flat surface extending parallel to the reciprocating direction of the piston.

With such configuration, in addition to the reduction of the dead volume formed in the discharge port and the enhancement of the efficiency of the compressor, the flow of gas flowing from the suction port to the discharge port can be blocked from going around the peripheral wall extending in the axial direction of the projection by the flat surface.

As a result, the gas blocked by the flat surface can be guided in the direction of the discharge port, the accumulation (remaining) of the gas in the compression chamber at the termination of the compression stroke is reduced, the suction loss involved in the re-expansion of the accumulated gas is reduced, and the input of the compressor is reduced.

The hermetic type compressor of the present invention has a configuration in which the projection is arranged so that the flat surface arranged at the projection faces the suction port side.

With such configuration, the flow of gas that flowed in from the suction port and directed towards the discharge port can be blocked. The flow of gas directed towards the discharge port is generated therewith, and in particular, the compression load at the termination of the compression stroke can be alleviated, and the input of the compressor can be reduced.

The hermetic type compressor of the present invention has a configuration in which the angle θ formed with the distal end face of the piston of the flat surface is in a range of $70° \leqq \theta \leqq 90°$.

With such configuration, the flow of gas towards the discharge port becomes smooth, and in particular, the accumulation (remaining) of the gas in the compression chamber at the termination of the compression stroke can be reduced. Thus, the suction loss involved in the re-expansion of the accumulated gas can be reduced, and the input of the compressor can be reduced.

The hermetic type compressor of the present invention has a configuration in which the intersecting portion with the distal end face of the piston at the projection is a curved surface of a predetermined diameter.

With such configuration, the flow of the gas from the distal end face side of the piston towards the discharge port becomes smooth, and in particular, the compression load at the termination of the compression stroke can be alleviated, and the input of the compressor can be reduced.

The hermetic type compressor of the present invention has a configuration in which the direction of the flat surface is a direction in which the line Y, which is orthogonal to the flat surface and which passes the center of the flat surface, is in a positional relationship of intersecting between the axial center of the suction port and the axial center of the piston at the line Z passing the axial center of the suction port and the axial center of the piston.

With such configuration, the direction of the flat surface arranged at the projection can be made to a direction of easily blocking the flow of the gas towards the discharge port, and the flow of the gas towards the discharge port can be rationally generated. In particular, the compression load at the termination of the compression stroke can be alleviated, and the input of the compressor can be reduced.

The hermetic type compressor of the present invention has a configuration in which the direction of the flat surface is arranged such that the extended line X of the flat surface facing the axial center side of the piston in the flat surface forms an angle α with respect to the line Z passing the axial center of the suction port and the axial center of the piston, where the angle α is in a range of $15° \leqq \alpha \leqq 75°$ or in a range of $105° \leqq \alpha \leqq 150°$.

With such configuration, the setting of the angle α is an angle of efficiently guiding the gas flowing with complicating behavior from the suction port to the discharge port. The re-expansion loss involved in the accumulation (remaining) of the gas at the termination of the compression stroke is thus reduced, and the effect of having the input of the compressor to a minimum can be expected.

The hermetic type compressor of the present invention has a configuration in which the shape of the projection is such that the cross-sectional shape by a surface parallel to the distal end face of the piston is a polygonal shape including a plurality of flat surfaces.

With such configuration, the flow of the gas flowing from the suction port towards the discharge port is blocked from going around the peripheral wall extending in the axial direction of the projection by the plurality of flat surfaces forming the polygon, and the gas blocked by the flat surface can be guided in the direction of the discharge port. Thus, the accumulation (remaining) of the gas in the compression chamber at the termination of the compression stroke can be further reduced. As a result, the suction loss involved in the re-expansion of the accumulated gas can be reduced, and the input of the compressor can be further reduced.

The hermetic type compressor of the present invention has a configuration in which the shape of the projection is such that the cross-sectional shape by a surface parallel to the distal end face of the piston is a rectangle.

With such configuration, the flow of the gas towards the discharge port in the flow of the gas flowing from the suction port towards the discharge port is made to a flow surrounding the projection and flowing along the plurality of flat surfaces. Thus, the flow is suppressed from going around to the peripheral direction of the projection, and the gas can be smoothly guided in the direction of the discharge port. As a result, the accumulation (remaining) of the gas in the compression chamber at the termination of the compression stroke can be reduced, the suction loss involved in the re-expansion of the accumulated gas can be reduced, and the input of the compressor can be reduced.

The hermetic type compressor of the present invention has a configuration in which the cross-sectional area of the discharge port becomes greater from the compression chamber side towards the opposite side of the compression chamber.

With such configuration, the passage resistance formed by the projection and the peripheral wall of the discharge port can be made as small as possible. As a result, the flow out of the compressed gas from the discharge port becomes smooth, the compression load at the termination of the compression stroke can be alleviated, and the effect of having the input of the compressor to a minimum can be expected.

The hermetic type compressor of the present invention has a configuration in which the axial center of the projection coincides with the axial center of the discharge port.

With such configuration, the passage of the gas formed with the projection in the discharge port can become symmetric, the flow-out patch of the gas involved in the shifted passage area becomes natural, the suction loss involved in the re-expansion of the gas accumulated in the compression chamber can be further reduced, and the input of the compressor can be reduced.

The hermetic type compressor of the present invention has a configuration in which the bell-mouth portion, in which the cross-sectional area becomes smaller from the compression chamber side towards the opposite side of the compression chamber, is arranged at the corner on the compression chamber side of the discharge port.

With such configuration, the gas guided in the direction of the discharge port by the projection of the piston can be more smoothly guided to the discharge port at the termination of the compression stroke. As a result, the accumulation (remaining) of the gas in the compression chamber at the termination of the compression stroke is reduced, the suction loss involved in the re-expansion of the accumulated gas is reduced, and the input of the compressor can be reduced.

Furthermore, the freezer unit of the present invention includes a refrigerant circuit in which the compressor, the condenser, the expansion device, and the evaporator are annularly coupled by a piping, where the compressor has a configuration of the hermetic type compressor described above.

With such configuration, the operation in which the power consumption (amount) is suppressed can be realized by mounting the high efficiency hermetic type compressor.

What is claimed is:

1. A hermetic type compressor comprising an electrical element and a compression element driven by the electrical element in an hermetic vessel, the compression element including a cylinder block with a compression chamber space, a piston that reciprocates in the compression chamber space, and a valve plate being arranged at an end of the compression chamber space and forming a compression chamber with the piston, the valve plate including a suction port to which gas to be compressed in the compression chamber flows in and a discharge port from which gas compressed in the compression chamber is discharged, wherein a projection that appears from the discharge port with the reciprocating movement of the piston is arranged at a distal end face of the piston and at a position facing the discharge port, the projection includes a flat surface formed at a side surface of the projection, extending substantially parallel to a reciprocating direction of the piston and facing an axial center side of the piston, the discharge port is formed as a circle, and a cross-sectional area of the discharge port becomes continuously greater from a surface of the valve plate on the compression chamber side towards an opposite surface of the valve plate on an outside of the compression chamber.

2. The hermetic type compressor according to claim 1, wherein the projection is arranged so that the flat surface arranged at the projection faces the suction port side on the valve plate.

3. The hermetic type compressor according to claim 1, wherein an intersecting portion with the distal end face of the piston at the projection is a curved surface of a predetermined diameter.

4. The hermetic type compressor according to claim 1, wherein a direction of the flat surface is a direction in which a line Y, which is orthogonal to the flat surface and which passes a center of the flat surface, is in a positional relationship of intersecting between an axial center of the suction port and an axial center of the piston at a line Z passing the axial center of the suction port and the axial center of the piston.

5. The hermetic type compressor according to claim 1, wherein a direction of the flat surface is arranged such that an extended line X of the flat surface facing an axial center side of the piston in the flat surface forms an angle $\alpha$ with respect to a line Z passing an axial center of the suction port and an axial center of the piston, the angle $\alpha$ being in a range of $15° \leqq \alpha \leqq 75°$ or in a range of $105° \leqq \alpha \leqq 150°$.

6. The hermetic type compressor according to claim 1, wherein a shape of the projection is such that a cross-sectional shape by a surface parallel to the distal end face of the piston is a polygonal shape.

7. The hermetic type compressor according to claim 1, wherein a shape of the projection is such that a cross-sectional shape by a surface parallel to the distal end face of the piston is a rectangle.

8. The hermetic type compressor according to claim 1, wherein an axial center of the projection coincides with an axial center of the discharge port.

9. The hermetic type compressor according to claim 1, wherein a bell-mouth portion, in which a cross-sectional area becomes smaller from the compression chamber side towards an opposite side of the compression chamber, is arranged at a corner on the compression chamber side of the discharge port.

10. A freezer unit comprising a refrigerant circuit in which a compressor, a condenser, an expansion device, and an evaporator are annularly coupled by a piping, the compressor being the hermetic type compressor according to claim 1.

11. A hermetic type compressor comprising an electrical element and a compression element driven by the electrical element in an hermetic vessel, the compression element including a cylinder block with a compression chamber space, a piston that reciprocates in the compression chamber space, and a valve plate being arranged at an end of the compression chamber space and forming a compression chamber with the piston, the valve plate including a suction port to which gas to be compressed in the compression chamber flows in and a discharge port from which gas compressed in the compression chamber is discharged, wherein a projection that appears from the discharge port with the reciprocating movement of the piston is arranged at a distal end face of the piston and at a position facing the discharge port, the projection includes a flat surface formed at a side surface of the projection, extending in a reciprocating direction of the piston, formed at a side surface of the projection and facing an axial center side of the piston, the discharge port is formed as a circle, a cross-sectional area of the discharge port becomes continuously greater from a surface of the valve plate on the compression chamber side towards an opposite surface of the valve plate on an outside of the compression chamber, and an angle $\theta$ between the distal end face of the piston and the flat surface is in a range of $70° \leqq \theta \leqq 90°$.

* * * * *